US008500475B2

(12) United States Patent
Takehara et al.

(10) Patent No.: US 8,500,475 B2
(45) Date of Patent: Aug. 6, 2013

(54) HARNESS CONNECTOR

(75) Inventors: Hideaki Takehara, Hitachi (JP); Kunihiro Fukuda, Tsukuba (JP); Sachio Suzuki, Hitachi (JP); Yuta Kataoka, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 191 days.

(21) Appl. No.: 12/886,602

(22) Filed: Sep. 21, 2010

(65) Prior Publication Data

US 2011/0070761 A1 Mar. 24, 2011

(30) Foreign Application Priority Data

Sep. 24, 2009 (JP) ..... 2009-219633
Oct. 8, 2009 (JP) ..... 2009-234354
Oct. 9, 2009 (JP) ..... 2009-235641

(51) Int. Cl.
*H01H 13/62* (2006.01)

(52) U.S. Cl.
USPC ..... 439/262; 439/210; 174/88 B

(58) Field of Classification Search
USPC ..... 439/271–259, 262–279
See application file for complete search history.

(56) References Cited

U.S. PATENT DOCUMENTS 3,183,298 A * 5/1965 Weimer et al. ..... 174/88 B
3,504,100 A * 3/1970 Keiji et al. ..... 174/88 B
4,009,920 A * 3/1977 Hicks et al. ..... 439/213
4,174,143 A * 11/1979 Hicks et al. ..... 439/213
4,627,680 A * 12/1986 Weimer et al. ..... 439/210
5,619,014 A * 4/1997 Faulkner ..... 174/68.2
5,760,339 A * 6/1998 Faulkner et al. ..... 174/88 B
6,793,513 B2 * 9/2004 Shibata ..... 439/271
8,226,429 B2 * 7/2012 Umetsu et al. ..... 439/262

FOREIGN PATENT DOCUMENTS

JP 2004-056924 2/2004
JP 4037199 11/2007
JP 2009-070754 4/2009

* cited by examiner

*Primary Examiner* — Renee Luebke
*Assistant Examiner* — Larisa Tsukerman
(74) *Attorney, Agent, or Firm* — Antonelli, Terry, Stout & Kraus, LLP.

(57) ABSTRACT

There is provided a harness connector comprising: a first terminal housing with plural first connector terminals aligned and accommodated therein; a second terminal housing with plural second connector terminals aligned and accommodated therein, the second terminal housing being engaged with the first terminal housing in use, each of the first connector terminals being connected with a counterpart one of the second connector terminals; and a pressing member, wherein: when the first and second terminal housings are engaged with each other, the first and second connector terminals are alternately stacked in such a manner as to provide a stack of plural terminal pairs consisting of a different one of the first connector terminals and its counterpart second connector terminal; the first and second connector terminals of each terminal pair are fixed each other by the pressing member and are electrically connected; and neighboring terminal pairs are electrically insulated from each other.

19 Claims, 20 Drawing Sheets

(a)

(b)

HARNESS CONNECTOR

CLAIM OF PRIORITY

The present application claims priority from Japanese patent applications: serial no. 2009-219633 filed on Sep. 24, 2009; serial no. 2009-234354 filed on Oct. 8, 2009; and serial no. 2009-235641 filed on Oct. 9, 2009, the contents of which are hereby incorporated by reference into this application.

BACKGROUND OF THE INVENTION

1. Field of the Invention

The present invention relates to harness connectors, and particularly to harness connectors which can be advantageously used for electrical power harnesses for transmitting high capacity electrical power (for example, electrical power harnesses for use in low-emission vehicles such as hybrid vehicles and electric vehicles).

2. Description of Related Art

Electrical power harnesses for transmitting high capacity electrical power between electrical devices (e.g., between a motor and an inverter or between an inverter and a battery) are used in today's ever evolving low-emission vehicles (such as hybrid vehicles and electric vehicles). Electrical power harnesses are connected to an electrical device, another harness or the like by a harness connector. Such a harness connector typically includes two separate parts: a male connector formed of a first terminal housing accommodating male connector terminals; and a female connector formed of a second terminal housing accommodating female connector terminals. In use, the male connector terminals are connected to the female connector terminals by inserting the male connector into the female connector. For example, see JP-A 2009-070754.

Various efforts are being made in current years to enhance the energy-saving performances of low-emission vehicles. One such effort is to reduce the weights of components of a low-emission vehicle to as low levels as possible. One effective approach for weight saving is downsizing.

For example, JP-B 4037199 discloses a technology for downsizing a vehicle use connector. JP-B 4037199 describes a vehicle use connector that connects the connector terminals of a plurality of power supply cables from an inverter for working a driving motor of the vehicle with the connector terminals of a plurality of conductor lines to the motor. In this vehicle use connector, a plurality of terminal pairs of the power supply cable connector terminal and the conductor line connector terminal and insulators disposed between neighboring terminal pairs are stacked; and this connector terminal stack is pressed together by a single bolt inserted in the stack.

That is, in the technology disclosed in JP-B 4037199, multiple terminal pairs of connector terminals are stacked and a single bolt is inserted in the stack. And, the electrical contacts between the connector terminals in the terminal pairs can be established by pressing the stack together by screwing the bolt. Such a connecting structure has an advantage over the technology disclosed in the above-mentioned JP-A 2009-070754 in that downsizing is more feasible.

However, the technology disclosed in JP-B 4037199 has the following problem to be solved. In the technology disclosed in JP-B 4037199, the electrical contacts between multiple pairs of connector terminals are obtained by pressing together a stack of the multiple pairs of connector terminals. Therefore, it is not always guaranteed all the pairs of connector terminals are equally pressed by the same force. Thus, the contact force may be different among the contact interfaces.

Such difference in contact force among contact interfaces may cause electrical connection failure in vibrating environments such as vehicles.

SUMMARY OF THE INVENTION

In view of the foregoing, it is an objective of the invention to provide a harness connector in which a stable contact force can be established at all the electrical contact interfaces.

According to one aspect of the present invention, there is provided a harness connector which comprises:

a first terminal housing with a plurality of first connector terminals aligned and accommodated therein;

a second terminal housing with a plurality of second connector terminals aligned and accommodated therein, the second terminal housing being engaged with the first terminal housing in use, each of the first connector terminals being connected with a counterpart one of the second connector terminals; and a pressing member, wherein:

when the first and second terminal housings are engaged with each other, the first and second connector terminals are alternately stacked in such a manner as to provide a stack of a plurality of terminal pairs consisting of a different one of the first connector terminals and its counterpart second connector terminal; the first and second connector terminals of each terminal pair are pressed and fixed against each other by means of the pressing member and are electrically connected; and neighboring terminal pairs are electrically insulated from each other.

In the above aspect of the present invention, the following modifications and changes can be made.

(i) The pressing member is electrically insulated from the other part of the harness connector, and the pressing member at least includes a bolt and a plurality of pressing portions each for pressing a corresponding one of the terminal pairs. When the first and second terminal housings are engaged with each other, the pressing member is inserted in the stack of the terminal pairs in such a manner that axis direction of the bolt of the pressing member is perpendicular to contact interfaces of the terminal pairs, and each pressing portion is positioned on the corresponding terminal pair.

(ii) Each of the first connector terminals is supported by means of a corresponding first support member provided in the first terminal housing so as to be aligned in a corresponding predetermined position.

(iii) The pressing member is electrically insulated from the other part of the harness connector; the pressing member at least includes a bolt and a plurality of pressing portions each for pressing a corresponding one of the terminal pairs; and an outer surface of each pressing portion has a male screw thread. Each first connector terminal has, on a surface opposite a contact surface adapted to contact the corresponding counterpart second connector terminal, a nut-like support member that has a hole through which the pressing member can pass; and an inner surface of the hole of each nut-like support member has a female screw thread that can engage with the male screw thread formed on an outer surface of a corresponding one of the pressing portions. When the first and second terminal housings are engaged with each other, the pressing member is inserted in the stack of the terminal pairs in such a manner that axis direction of the bolt of the pressing member is perpendicular to contact interfaces of the terminal pairs and each pressing portion is positioned on the corresponding terminal pair.

(iv) The pressing member is electrically insulated from the other part of the harness connector; the pressing member at least includes a head, a bolt and a plurality of pressing portions each for pressing a corresponding one of the terminal pairs; outer diameters of the pressing portions decrease stepwise along the bolt as the pressing portions get off from the head; and an outer surface of each pressing portion has a male screw thread. Each first connector terminal has, on a surface opposite a contact surface adapted to contact the corresponding counterpart second connector terminal, a nut-like support member that has a hole through which the pressing member can pass; and an inner surface of the hole of each nut-like support member has a female screw thread that can engage with the male screw thread formed on the outer surface of a corresponding one of the pressing portions. When the first and second terminal housings are engaged with each other, the pressing member is inserted in the stack of the terminal pairs in such a manner that axis direction of the bolt of the pressing member is perpendicular to contact interfaces of the terminal pairs and each pressing portion is positioned on the corresponding terminal pair.

(v) Each nut-like support member has therein a ratchet which disengages the nut-like support member from the pressing member when a screwing torque greater than a predetermined value is applied to the pressing member.

(vi) The pressing member is formed of a metal core rod and an insulator shell that covers an outer surface of the metal core rod as well as forming the pressing portions of the pressing member.

(vii) The first and/or second terminal housing has a pressing member-fixing portion for fixing the pressing member; and when the first and second terminal housings are engaged with each other, the first and second terminal housings are tightened against each other by means of the pressing member.

(viii) The pressing member has a male screw threaded end; the pressing member-fixing portion has, formed therein, a female screw thread that can engage with the male screw threaded end; and the pressing member-fixing portion is provided in an inner surface of the first terminal housing.

(ix) Each of the second connector terminals is supported by means of a corresponding second support member provided in the second terminal housing so as to be aligned in a corresponding predetermined position.

(x) The first and/or second terminal housing is provided with a waterproof seal for waterproofing between the first and second terminal housings when the first and second terminal housings are engaged with each other.

(xi) The first terminal housing is provided with a plurality of first cable insertion holes each for insertion of a cable which is in use connected to a corresponding one of the first connector terminals; and each first cable insertion hole is provided with a waterproof seal for waterproofing between the first terminal housing and the cable that is in use inserted through the first cable insertion hole. The second terminal housing is provided with a plurality of second cable insertion holes each for insertion of a cable that is in use connected to a corresponding one of the second connector terminals; and each second cable insertion hole is provided with a waterproof seal for waterproofing between the second terminal housing and the cable that is in use inserted through the second cable insertion hole.

(xii) Each of the first connector terminals has a first connecting portion to which a cable is connected in use, and all the first connecting portions are arranged in parallel. Each of the second connector terminals has a second connecting portion to that a cable is connected in use, and all the second connecting portions are arranged in parallel. The first and second terminal housings are engageable with each other in such a manner that axis direction of the first connecting portions is not parallel but obliquely oriented to that of the second connecting portions.

ADVANTAGES OF THE INVENTION

The present invention provides a harness connector in which a stable contact force can be established at all the electrical contact interfaces.

BRIEF DESCRIPTION OF THE DRAWINGS

FIG. 20 is a schematic illustration showing a front longitudinal view of the harness connector of FIG. 18 after the male connector is inserted into the female connector and the pressing member is screwed in.

DETAILED DESCRIPTION OF THE PREFERRED EMBODIMENTS

Figure 1:
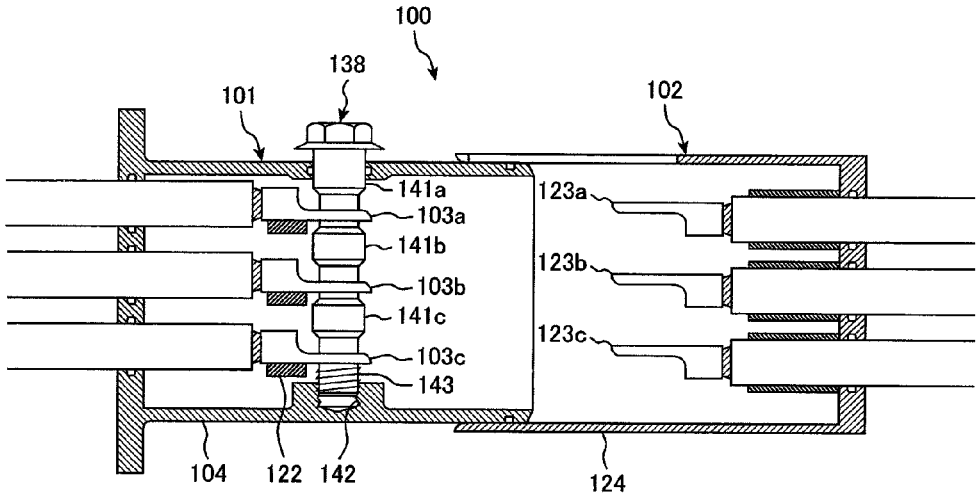
FIG. 1 is a schematic illustration showing a front longitudinal sectional view of an example of a harness connector according to a first embodiment of the present invention.

Preferred embodiments of the invention will be described below with reference to the accompanying drawings. However, the invention is not limited to the specific embodiments described below, but various combinations and modifications are possible without departing from the scope of the invention. Also, like parts are designated by like reference numerals without repeating the description thereof.

[First Embodiment of Present Invention]

FIG. 1 is a schematic illustration showing a front longitudinal sectional view of an example of a harness connector according to a first embodiment of the present invention. As illustrated in FIG. 1, a harness connector 100 according to the first embodiment includes a male connector 101 and a female connector 102. By inserting the male connector 101 into the female connector 102, a plurality of power supply lines in the male connector 101 can be collectively connected to the corresponding counterpart power supply lines in the female connector 102.

Figure 2:
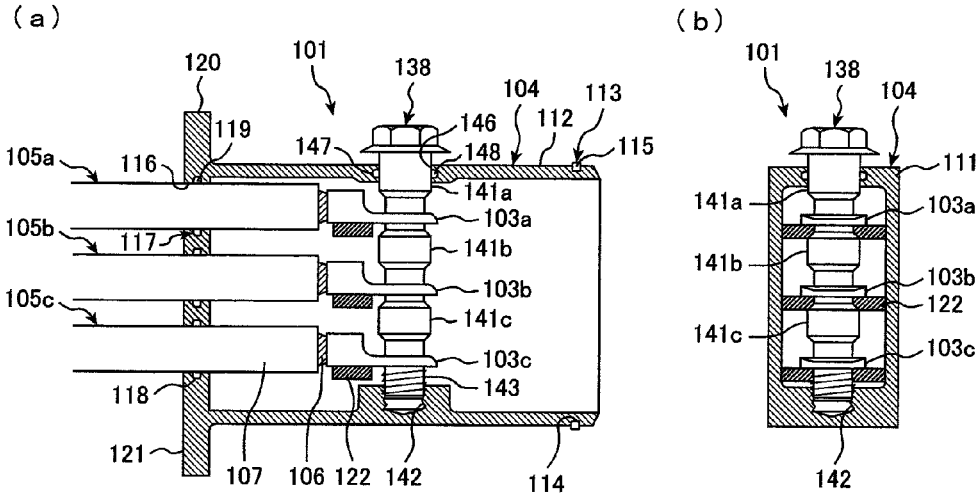
FIG. 2 is a schematic illustration showing a male connector of the harness connector of FIG. 1, in which (a) is a front longitudinal sectional view, and (b) is a side cross sectional view.

FIG. 2 is a schematic illustration showing a male connector of the harness connector of FIG. 1, in which (a) is a front longitudinal sectional view, and (b) is a side cross sectional view. As illustrated in FIG. 2, the male connector 101 includes an electrically conductive first terminal housing 104, which accommodates therein alignedly disposed three first (male) connector terminals 103*a*, 103*b* and 103*c*. The embodiments below are described using an example in which a later-described pressing member 138 (or 238 or 338) is provided in the male connector 101.

As used herein, the term "first terminal housing" means the housing in which the later-described pressing member is provided. And, the term "male terminal" means a terminal in the male connector. Also, herein, the description is made for the case where the first terminal housing is the male connector housing. However, the present invention is not limited to this configuration, but instead the first terminal housing may be the female connector housing.

The first connector terminals 103*a*, 103*b* and 103*c* are connected to cables 105*a*, 105*b* and 105*c*, respectively. The cables 105*a*, 105*b* and 105*c* are each formed by coating an insulation layer 107 around a conductor 106. The electrical current transmitted through the cables 105*a*, 105*b* and 105*c* may have the same or different electrical parameters (such as voltage value, current value and phase). For example, the first embodiment can be used for a three-phase AC power transmission between a motor and an inverter. In this case, three alternate currents, which are 120° out of phase with one another, are transmitted through the cables 105*a*, 105*b* and 105*c*.

The first terminal housing 104 is formed of a cylinder 112 having an open end and a closed end (see FIG. 2(*a*)). And, the cylinder 112 has a rectangular cross section (see FIG. 2(*b*)). The open end of the cylinder 112 preferably has a tapered outer surface in order to facilitate mating with the female connector 102. A waterproof seal 113 for waterproofing between the male connector 101 and the female connector 102 is provided on an outer surface of the cylinder 112 near the open end of the cylinder 112. The waterproof seal 113 is, for example, a packing 115 (such as an O-ring) inserted in a circumferential groove 114 formed in the outer surface of the cylinder 112 near its open end.

The closed end of the cylinder 112 (on the left side in FIG. 2(*a*)) has three cable insertion holes 116 for insertion of the cables 105*a*, 105*b* and 105*c* respectively connected to the first connector terminals 103*a*, 103*b* and 103*c*. Each cable insertion hole 116 has, on an inner surface thereof, an annular waterproof seal 117 for providing waterproof sealing between the cables (105*a*, 105*b* and 105*c*) and the cylinder 112. Each waterproof seal 117 is a packing 119 (such as an O-ring) inserted in an annular groove 118 formed in the inner surface of the corresponding cable insertion hole 116.

In order to fix the male connector 101 to a casing of an electrical device, a flange 120 having a fixing hole 149 (shown later in FIG. 8) is formed along the outer circumferential surface of the closed end of the cylinder 112. In order to provide waterproofing between the electrical device and the male connector 101, a seal such as a packing may be provided along a periphery 121 of a surface of the flange 120 facing the electrical device. The invention is not limited to the above-described configuration in which the male connector 101 is adapted to be fixable to the casing of an electrical device or the like. Instead, such a flange like the flange 120 may be provided on the female connector 102, or on both the male and female connectors 101 and 102. Or, both of the male and female connectors 101 and 102 may not be configured to be fixable to any electrical device.

In addition, a plurality of first support plates 122 extend between inner side surfaces of the cylinder 112. The first connector terminals 103*a*, 103*b* and 103*c* are supported from the back (from the lower side in the figure) by the respective first support plates 122 so that these connector terminals are aligned in respective predetermined positions (heights).

The first support plates 122 are made of an electrically insulation material such as resin in order to electrically insulate the first connector terminals 103*a*, 103*b* and 103*c* from one another and prevent short circuiting therebetween. The first support plates 122 allow the first connector terminals 103*a*, 103*b* and 103*c* to be stably held in respective predetermined positions, even when the cables 105*a*, 105*b* and 105*c* connected with the first connector terminals 103*a*, 103*b* and 103*c* are highly flexible. That is, any flexible cable can be used as the cables 105*a*, 105*b* and 105*c*, thus providing a higher degree of design freedom for routing the cables 105*a*, 105*b* and 105*c*. Needless to say, any rigid cable can also be used as the cables 105*a*, 105*b* and 105*c*. In this case, the first support plates 122 do not necessarily need to be provided in the cylinder 112.

The cylinder 112 is preferably made of an electrically and thermally good conducting, light-weight metal such as aluminum in order to increase the electromagnetic shielding and heat dissipating performances of the harness connector 100 and reduce the weight thereof. However, the cylinder 112 may also be made of resin or the like.

Figure 3:
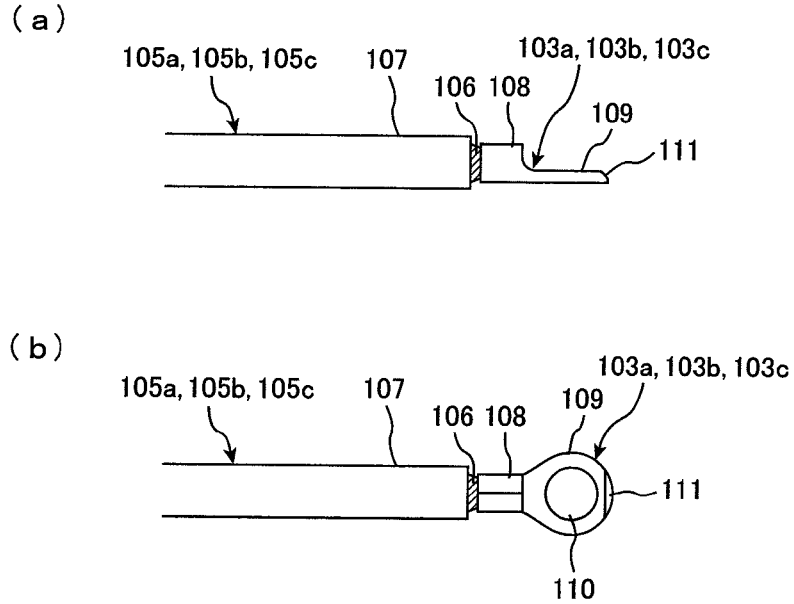
FIG. 3 is a schematic illustration showing a first connector terminal connected to a cable according to the present invention, in which (a) is a front view, and (b) is a top view.

FIG. 3 is a schematic illustration showing a first connector terminal connected to a cable according to the present invention, in which (a) is a front view, and (b) is a top view. As illustrated in FIG. 3, each of the first connector terminal 103*a*, 103*b* and 103*c* includes: a crimp portion 108 for crimping a blade terminal onto an exposed portion of the conductor 106 at an end of the corresponding one of the cables 105*a*, 105*b* and 105*c*; and a ring terminal 109 which is integral with the crimp portion 108. The hole 110 of each ring terminal 109 is for a purpose of insertion of the pressing member 138. The diameter of the hole 110 is larger than outer diameters of large diameter pressing portions 141 (described later in FIG. 6) of the pressing member 138. Preferably, a part of an outer upper annular edge of each ring terminal 109 has a tapered surface 111 in order to facilitate insertion into a later-described second connector terminal. FIG. 3 shows an example in which only a front part of the outer upper annular edge of the ring terminal 109 has the tapered surface 111. The first connector terminals 103*a*, 103*b* and 103*c* are preferably made of a highly conductive metal such as silver, copper and aluminum in order to reduce the power transmission loss at the harness connector 100.

Figure 4:
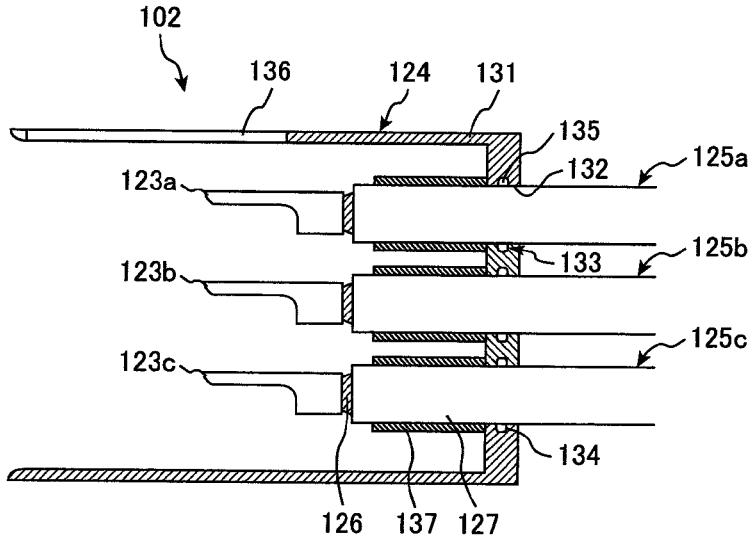
FIG. 4 is a schematic illustration showing a front longitudinal sectional view of a female connector of the harness connector of FIG. 1.

FIG. 4 is a schematic illustration showing a front longitudinal sectional view of a female connector of the harness connector of FIG. 1. As illustrated in FIG. 4, the female connector 102 includes a second terminal housing 124, which accommodates therein alignedly disposed multiple second connector terminals (female connector terminals) 123*a*, 123*b* and 123*c*. As previously pointed out, the invention is herein explained for the case where the second terminal housing (not having the pressing member) is the female connector housing. However, the invention is not limited to this configuration, but instead the second terminal housing may be the male connector housing.

The second connector terminals 123*a*, 123*b* and 123*c* are connected to cables 125*a*, 125*b* and 125*c*, respectively. The cables 125*a*, 125*b* and 125*c* are each formed by coating an insulation layer 127 around a conductor 126. The cables 125*a*, 125*b* and 125*c* are connected with the cables 105*a*, 105*b* and 105*c* via the first connector terminals (103*a*, 103*b* and 103*c*) and the second connector terminals (123*a*, 123*b* and 123*c*), respectively. Thus, electrical currents on the cables 105*a*, 105*b* and 105*c* are transmitted to the cables 125*a*, 125*b* and 125*c*.

The second terminal housing 124 is formed of a rectangular cross section cylinder 131 having an open end and a closed end. And, the cylinder 131 is formed to receive the first terminal housing 104. In the first embodiment, the first terminal housing 104 is configured to be inserted in the second terminal housing 124. Therefore, an inner surface of the open end of the second terminal housing 124 is preferably tapered in order to facilitate insertion of the first terminal housing 104.

The present invention is not limited to the above configuration, but instead the second terminal housing 124 may be configured to be inserted in the first terminal housing 104. In this case, preferably, the inner surface of the open end of the first terminal housing 104 is tapered, and the outer surface of the open end of the second terminal housing 124 is tapered. In this case also, preferably, the waterproof seal 113 is provided on the outer surface of the second terminal housing 124 near the open end thereof.

The closed end of the cylinder 131 (on the right side in FIG. 4) has three cable insertion holes 132 for insertion of the cables 125*a*, 125*b* and 125*c* respectively connected to the second connector terminals 123*a*, 123*b* and 123*c*. Each cable insertion hole 132 has, on an inner surface thereof, an annular waterproof seal 133 for providing waterproof sealing between the corresponding one of the cables (125*a*, 125*b* and 125*c*) and the cylinder 131. Each waterproof seal 133 is a packing 135 (such as an O-ring) inserted in a circumferential groove 134 formed in the inner surface of the corresponding cable insertion hole 132.

In order to allow an outwardly projecting portion (head) of the pressing member 138 to be inserted into the cylinder 131 when the male connector 101 is inserted into the female connector 102, a longitudinal cut-out 136 extending from the open end of the cylinder 131 is formed in an upper wall of the cylinder 131.

In addition, a plurality of second support tubes 137 extend from a closed end wall of the cylinder 131. The second support tubes 137 respectively enclose and support the cables 125*a*, 125*b* and 125*c* connected to the second connector terminals 123*a*, 123*b* and 123*c* so that the second connector terminals 123*a*, 123*b* and 123*c* are alignedly positioned in respective predetermined positions. Herein, the second connector terminals 123*a*, 123*b* and 123*c* are supported by the corresponding second support tubes 137 in such a manner as to mate with the corresponding counterpart first connector terminals 103*a*, 103*b* and 103*c* when the male connector 101 is inserted into the female connector 102.

The second connector terminals 123*a*, 123*b* and 123*c* are not directly supported by the second support tubes 137, and therefore they can be displaced to some extent. Instead of this configuration, the second connector terminals 123*a*, 123*b* and 123*c* may be directly supported by the second support tubes 137. In this case, however, the second support tubes 137 need to be so designed that the second connector terminals 123*a*, 123*b* and 123*c* can be displaced to some extent.

The second support tubes 137 are made of an electrically insulation material such as resin in order to electrically insulate the second connector terminals 123*a*, 123*b* and 123*c* from one another and prevent short circuiting therebetween. The second support tubes 137 allow the second connector terminals 123*a*, 123*b* and 123*c* to be stably held in respective predetermined positions, even when the cables 125*a*, 125*b* and 125*c* connected with the second connector terminals 123*a*, 123*b* and 123*c* are highly flexible. That is, any flexible cable can be used as the cables 125*a*, 125*b* and 125*c*, thus providing a higher degree of design freedom for routing the cables 125*a*, 125*b* and 125*c*. Needless to say, any rigid cable can also be used as the cables 125*a*, 125*b* and 125*c*. In this case, the second support tubes 137 do not necessarily need to be provided in the cylinder 131.

The cylinder 131 is preferably made of an electrically and thermally good conducting, light-weight metal such as aluminum in order to increase the electromagnetic shielding and heat dissipating performances of the harness connector 100 and reduce the weight thereof. However, the cylinder 131 may also be made of resin or the like.

Figure 5:
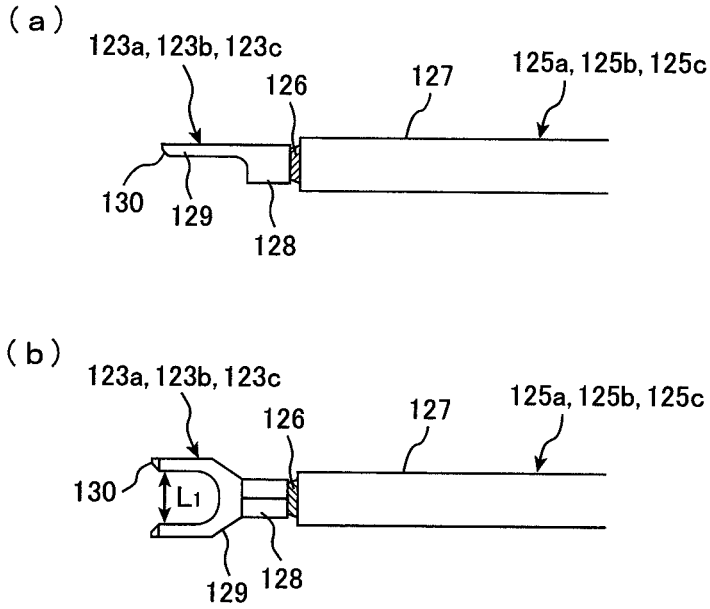
FIG. 5 is a schematic illustration showing a second connector terminal connected to a cable according to the present invention, in which (a) is a front view, and (b) is a top view.

FIG. 5 is a schematic illustration showing a second connector terminal connected to a cable according to the present invention, in which (a) is a front view, and (b) is a top view. As illustrated in FIG. 5, each of the second connector terminals 123*a*, 123*b* and 123*c* includes: a crimp portion 128 for crimping a blade terminal onto an exposed portion of the conductor 126 at an end of the corresponding one of the cables 125*a*, 125*b* and 125*c*; and a spade terminal (sometimes called a split ring terminal or an U-shaped terminal) 129 which is integral with the crimp portion 128.

The gap $L_1$ between the two legs of the spade terminal (U-shaped terminal) 129 is sized to be smaller than the outer diameters of the large diameter pressing portions 141 (described later in FIG. 6) of the pressing member 138. Preferably, the ends of the two legs of the spade terminal 129 have a tapered lower surface 130 in order to facilitate insertion. The second connector terminals 123*a*, 123*b* and 123*c* are preferably made of a highly conductive metal such as silver, copper and aluminum in order to reduce the power transmission loss at the harness connector 100.

As described above, in the harness connector 100 according to the first embodiment, when the male connector 101 is inserted into the female connector 102, the second connector terminals 123*a*, 123*b* and 123*c* mate with and stack on the respective counterpart first connector terminals 103*a*, 103*b* and 103*c*. And, by pressing force of the pressing member 138, the second connector terminals 123*a*, 123*b* and 123*c* are fixed to and electrically connected to the respective counterpart first connector terminals 103*a*, 103*b* and 103*c*. Herein, the three pairs of the first and second connector terminals 103*a* and 123*a*, 103*b* and 123*b*, and 103*c* and 123*c* are electrically insulated from each other.

Figure 6:
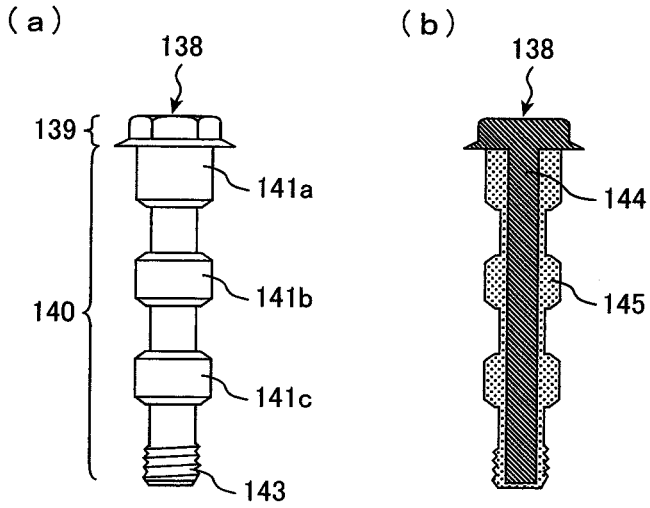
FIG. 6 is a schematic illustration showing a pressing member according to the first embodiment, in which (a) is a front view, and (b) is a front longitudinal sectional view.

FIG. 6 is a schematic illustration showing a pressing member according to the first embodiment, in which (a) is a front view, and (b) is a front longitudinal sectional view. As illustrated in FIG. 6(*a*), the pressing member 138 is a bolt 140 with a head 139, such as a hexagon headed bolt with a flange. The bolt 140 includes: three large diameter pressing portions 141*a*, 141*b* and 141*c* respectively for pressing the corresponding pairs of the first and second connector terminals 103*a* and 123*a*, 103*b* and 123*b*, and 103*c* and 123*c*; and a male screw threaded end 143.

A lower annular edge of the large diameter pressing portion 141*a*, and upper and lower annular edges of the large diameter pressing portions 141*b* and 141*c* are chamfered or tapered to facilitate insertion of the second connector terminals 123*a*, 123*b* and 123*c*. In addition, as illustrated in FIGS. 1 and 2, the pressing member 138 is disposed in such a manner that axis direction of the bolt 140 is perpendicular to the three contact interfaces between the first connector terminals 103*a*, 103*b* and 103*c* and the second connector terminals 123*a*, 123*b* and 123*c*; and that the pair of the first and second connector terminals 103*a* and 123*a* is positioned between the large diameter pressing portions 141*a* and 141*b*, the pair of the first and second connector terminals 103*b* and 123*b* is positioned between the large diameter pressing portions 141*b* and 141*c*, and the pair of the first and second connector terminals 103*c* and 123*c* is positioned between the large diameter pressing portion 141*c* and the male screw threaded end 143. A female screw 142 as a pressing member-fixing portion is provided in a bottom wall (on the lower side in FIGS. 1 and 2) of the cylinder 112 in order to threadedly engage with the male screw threaded end 143 of the pressing member 138.

As illustrated in FIG. 6(*b*), the pressing member 138 preferably includes: a core rod 144 made of metal; and an insulator shell 145 made of an insulator that covers an outer surface of the core rod 144 as well as forming the large diameter pressing portions 141*a*, 141*b* and 141*c*. Examples of the metal used for the core rod 144 are SUS (stainless steel), iron, and copper alloys. And, examples of the insulator for the insulator shell 145 are polyphenylene sulfide (PPS) resins, polyphthalamide (PPA) resins, polyamide (PA) resins, and epoxy resins. The pressing member 138 having such a composite structure of the core metal rod 144 and the insulator shell 145 has a stronger mechanical strength than any pressing member entirely formed of a resin. As described above, the insulator shell 145 (including the large diameter pressing portions 141*a*, 141*b* and 141*c*) are made of a resin, and therefore the pressing member 138 can be electrically insulated from the other part of the harness connector 100 and the large diameter pressing portions 141*a*, 141*b* and 141*c* can be easily shaped. Instead of the above structure, the male screw threaded end 143 may be left uncovered with the insulator shell 145 in order to enhance the durability and the clamping force of the male screw threaded end 143.

As illustrated in FIGS. 1 and 2, the pressing member 138 is inserted through an upper wall (the upper side in FIGS. 1 and 2) of the cylinder 112. Thus, the upper wall of the cylinder 112 is provided with a pressing member insertion hole 146 for insertion of the pressing member 138. The pressing member insertion hole 146 has, on an inner surface thereof, an annular waterproof seal for providing waterproof sealing between the pressing member 138 and the cylinder 131. The annular waterproof seal is an annular packing 148 (such as an O-ring) inserted in an annular groove 147 formed in the inner surface of the hole 146. In the first embodiment, the pressing member 138 is preinserted in the pressing member insertion hole 146 before the male connector 101 is inserted into the female connector 102.

Next, the connection between the first connector terminals 103*a*, 103*b* and 103*c* and the second connector terminals 123*a*, 123*b* and 123*c* in the harness connector 100 of the first embodiment will be described.

Figure 7:
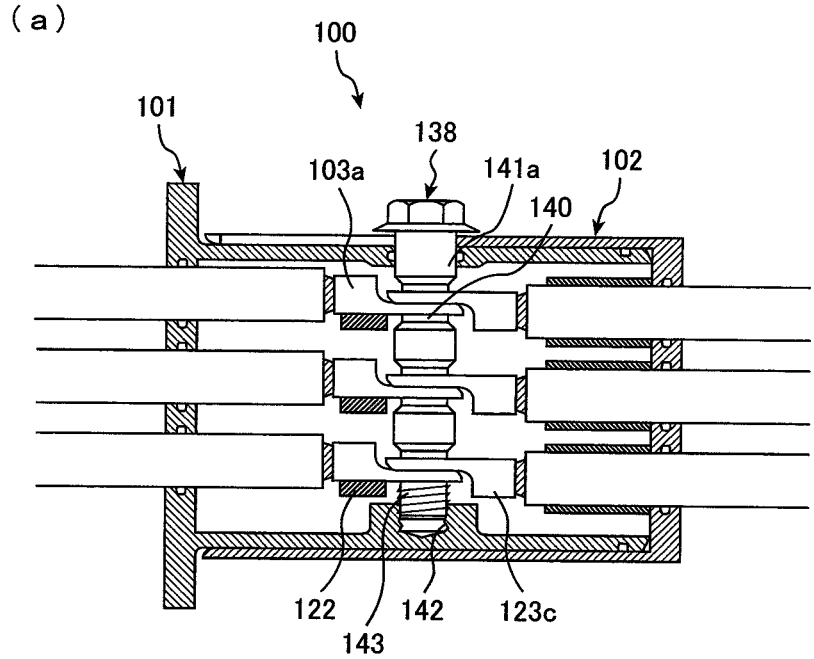
FIG. 7 is a schematic illustration showing the harness connector of FIG. 1 after the male connector is inserted into the female connector, in which (a) is a front longitudinal sectional view, and (b) is a top view.
Figure 7:
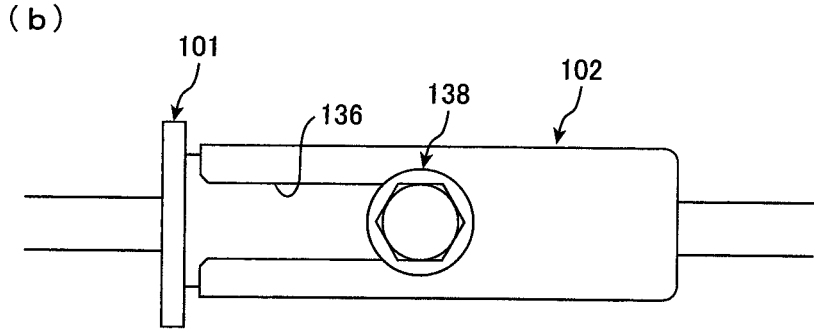

FIG. 7 is a schematic illustration showing the harness connector of FIG. 1 after the male connector is inserted into the female connector, in which (a) is a front longitudinal sectional view, and (b) is a top view. As illustrated in FIGS. 7(*a*) and 7(*b*), when the male connector 101 is inserted into the female connector 102, the second connector terminals 123*a*, 123*b* and 123*c* are inserted between the first connector terminals 103*a*, 103*b* and 103*c* and the large diameter pressing portions

141*a*, 141*b* and 141*c*, respectively. Herein, the upwardly projecting portion of the pressing member 138 is allowed to be inserted into the longitudinal cut-out 136, and thus does not prevent the male connector 101 from being inserted into the female connector 102.

Figure 8:
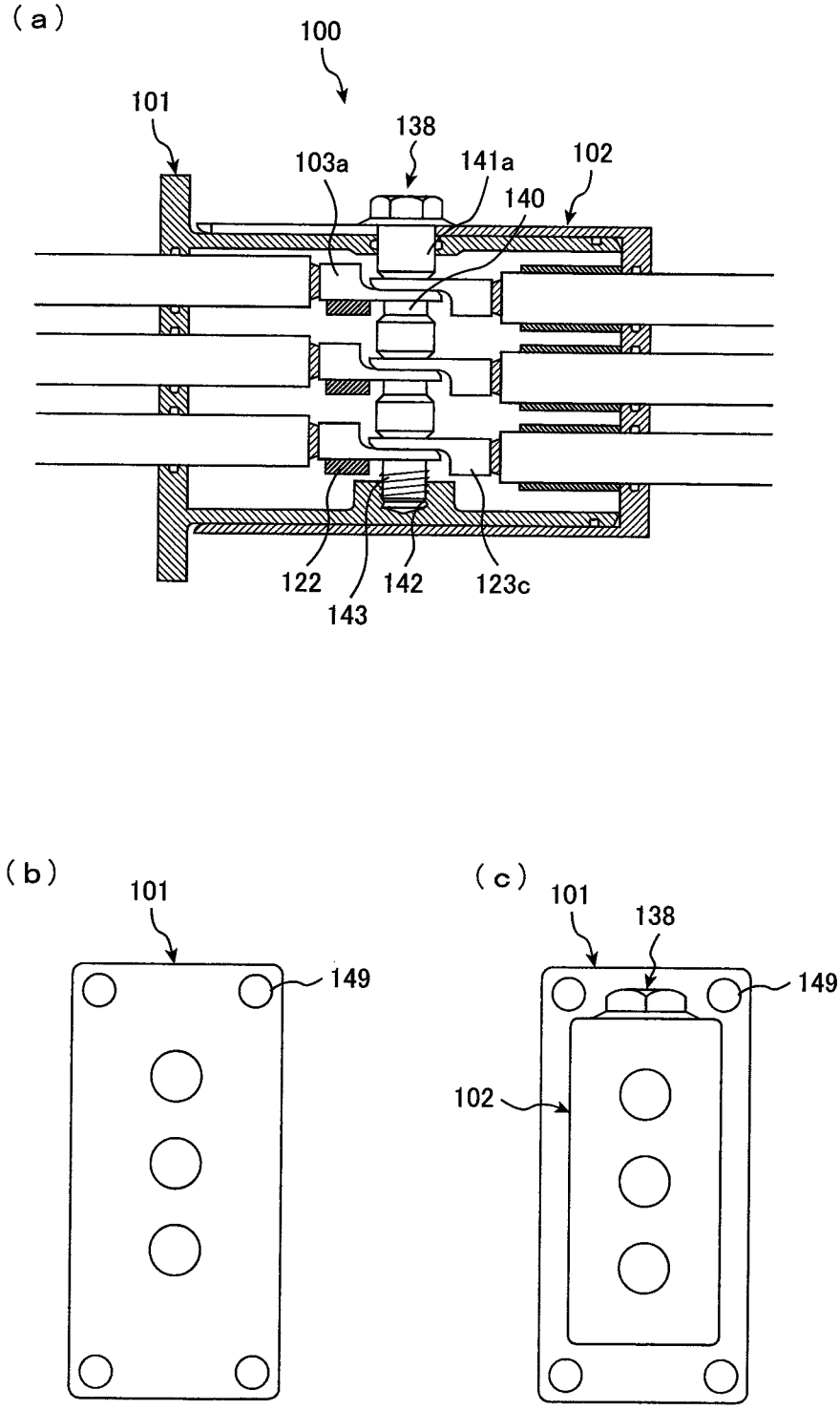
FIG. 8 is a schematic illustration showing the harness connector of FIG. 1 after the pressing member is further screwed in from the position shown in FIG. 7, in which (a) is a front longitudinal sectional view, (b) is a side view as viewed from the male connector side, and (c) is a side view as viewed from the female connector side.

FIG. 8 is a schematic illustration showing the harness connector of FIG. 1 after the pressing member is further screwed in from the position shown in FIG. 7, in which (a) is a front longitudinal sectional view, (b) is a side view as viewed from the male connector side, and (c) is a side view as viewed from the female connector side. As illustrated in FIG. 8, when the pressing member 138 is further screwed in, the male screw threaded end 143 of the pressing member 138 is screwed into the bottom of the female screw 142 of pressing member-fixing portion. By this axial movement of the pressing member 138 toward the bottom of the male connector 101, the large diameter pressing portions 141*a*, 141*b* and 141*c* press the second connector terminals 123*a*, 123*b* and 123*c* against the first connector terminals 103*a*, 103*b* and 103*c*, respectively. The first connector terminals 103*a*, 103*b* and 103*c* are each supported from the back by the corresponding first support plate 122. Thus, the second connector terminals 123*a*, 123*b* and 123*c* are forced into strong contact with the first connector terminals 103*a*, 103*b* and 103*c*, respectively. In addition, the head 139 of the pressing member 138 presses the second terminal housing 124 against the first terminal housing 104. Thus, the first terminal housing 104 and the second terminal housing 124 are tightened against each other.

As described above, in the first embodiment, the second connector terminals 123*a*, 123*b* and 123*c* are pressed by the pressing member 138 against the first connector terminals 103*a*, 103*b* and 103*c*, respectively. As a result, strong mechanical contact and therefore stable electrical contact are provided at all the contact interfaces between the second connector terminals 123*a*, 123*b* and 123*c* and the corresponding first connector terminals 103*a*, 103*b* and 103*c*. Hence, a harness connector can be achieved which is particularly beneficially used in vibrating environments such as vehicles.

Figure 9:
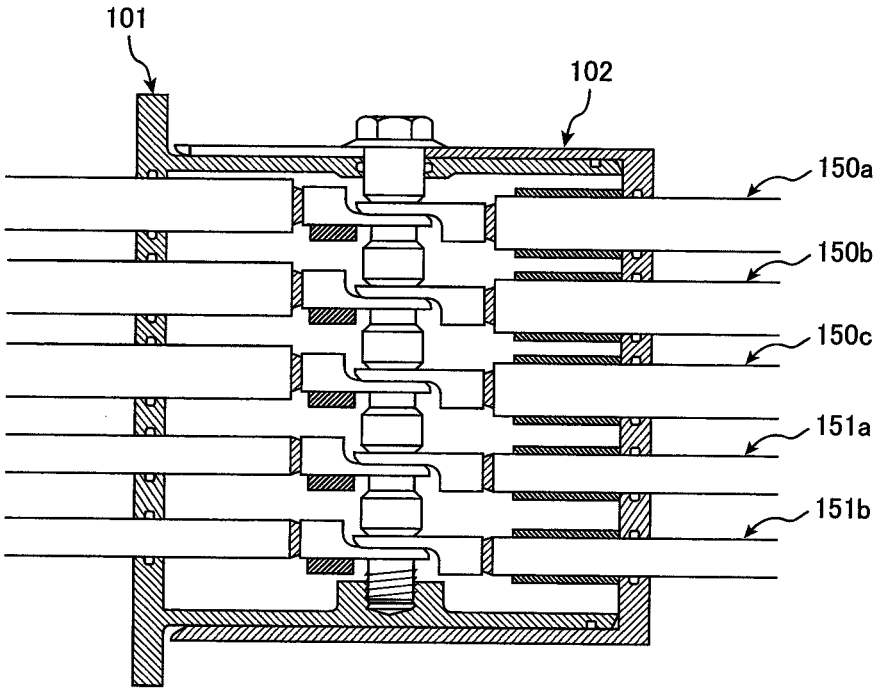
FIG. 9 is a schematic illustration showing a front longitudinal sectional view of another example of a harness connector according to the first embodiment of the present invention.

The above description is made with reference to a three-phase AC power transmission. However, the technical spirit of the present invention is not limited to such an application. FIG. 9 is a schematic illustration showing a front longitudinal sectional view of another example of a harness connector according to the first embodiment of the present invention. The harness connector illustrated in FIG. 9 is for use in vehicles, and includes: upper three lines 150*a*, 150*b* and 150*c* of a three-phase AC power transmission between a motor and an inverter; and lower two lines 151*a* and 151*b* of a two-phase DC power supply for an air conditioner. By using this harness connector, several different power supplies for different purposes can be collectively connected to an electrical device, a harness cable, or the like, thus eliminating the need for using several different connectors. Thus, space and cost can be saved.

In the above description, each spade terminal 129 is in facial contact with the corresponding ring terminal 109. However, the present invention is not limited such a contact structure. For example, a protrusion portion may be formed on the contact surface of each ring terminal 109, and the protrusion portion of each ring terminal 109 (male terminal) may be invaginated into a split portion of the corresponding spade terminal 129 (female terminal). Or, the ring and spade terminals 109 and 129 may be surface-roughened by knurling or the like. This increases the friction at each contact interface and makes it more difficult for each spade terminal 129 to move relative to its counterpart ring terminal 109 (i.e., causes each second connector terminal to be more firmly fixed to the corresponding first connector terminal). Thus, the first connector terminals 103*a*, 103*b* and 103*c* and the second connector terminals 123*a*, 123*b* and 123*c* can be brought into stronger contact with each other.

Figure 10:
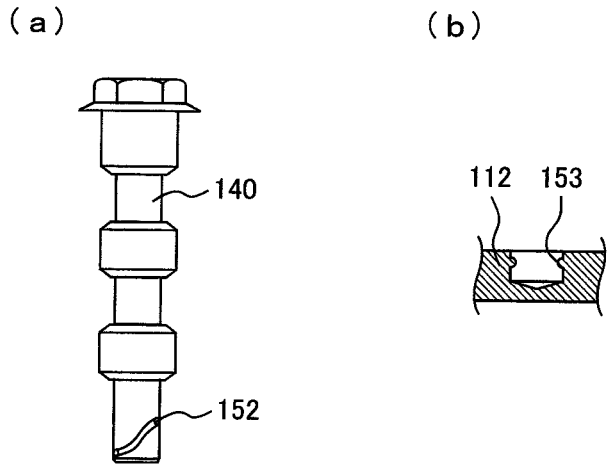
FIG. 10 is a schematic illustration showing a variation of a pressing member according to the first embodiment of the present invention, in which (a) is a front view, and (b) is a view showing a female screw of a pressing member-fixing portion into which the male screw threaded end of the pressing member shown in (a) can be threadedly engaged.

FIG. 10 is a schematic illustration showing a variation of the pressing member according to the first embodiment of the present invention, in which (a) is a front view, and (b) is a view showing a female screw of a pressing member-fixing portion into which the male screw threaded end of the pressing member shown in (a) is to be threadedly engaged. As illustrated in FIG. 10, a helical screw groove 152 (having a larger pitch than the threads of the male screw threaded end 143 of the pressing member 138) is formed in the outer surface of un-headed end of the bolt 140 as a variation of the pressing member 138 shown in FIG. 10(*a*), and a female screw 53, which can threadedly engage with the helical groove of the bolt 140, is formed in the bottom wall of the cylinder 112 as a pressing member-fixing portion. The variation of the pressing member 138 shown in FIG. 10 has a larger screw pitch, and therefore has an advantage in that a smaller number of rotations thereof can press the female connector terminals against the male connector terminals.

Figure 11:
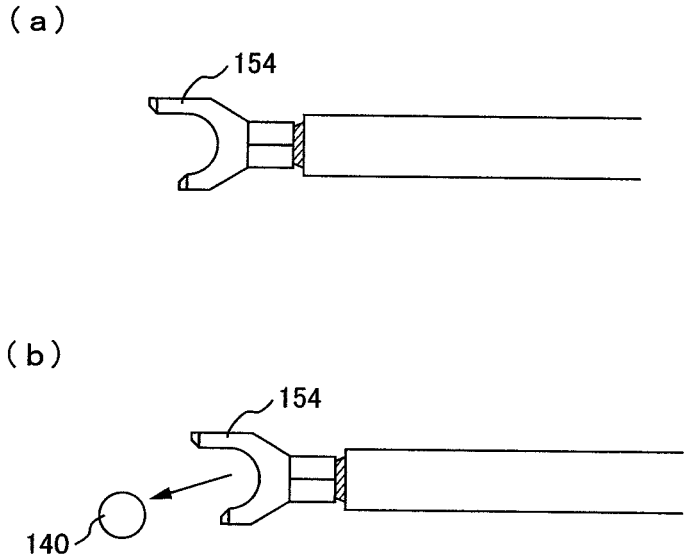
FIG. 11 is a schematic illustration showing a variation of the second connector terminal (to which a cable is connected) according to the present invention, in which (a) is a top view, and (b) is a view showing how the second connector terminal shown in (a) is engaged onto the bolt of pressing member.

Also, in the above description, the two legs of each spade terminal (U-shaped terminal) 129 have the same length (see FIG. 5). However, the present invention is not limited to such a structure. FIG. 11 is a schematic illustration showing a variation of the second connector terminal (to which a cable is connected) according to the present invention, in which (a) is a top view, and (b) is a view showing how the second connector terminal shown in (a) is engaged onto the bolt of pressing member. As illustrated in FIG. 11(*a*), one leg of the U-shaped terminal 129 may be longer than the other. That is, the second connector terminals may have a J-shaped terminal 154. As illustrated in FIG. 11(*b*), by using the J-shaped terminal 154, each second connector terminal (to which a cable is straightly connected) can be engaged onto the bolt 140 of the pressing member 138 even from a direction oblique to the axis of the cable.

Figure 12:
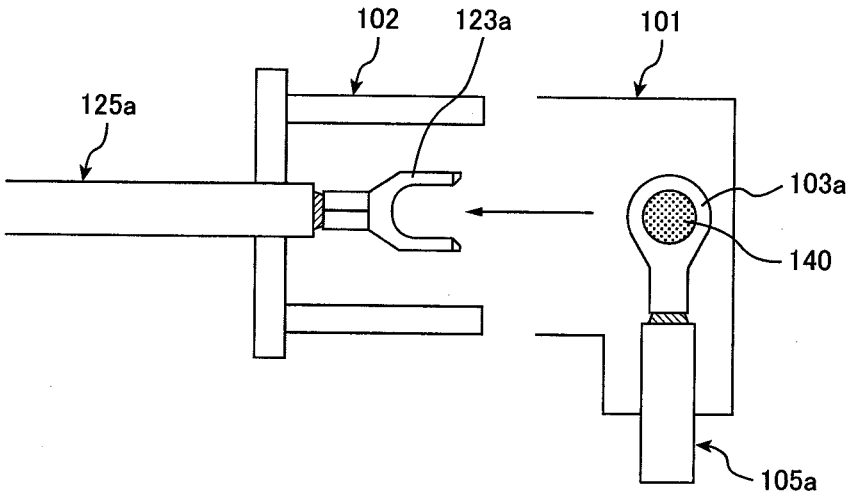
FIG. 12A is a schematic illustration showing a top longitudinal sectional view of still another example of a harness connector according to the present invention.
FIG. 12B is a schematic illustration showing a top longitudinal sectional view of yet another example of a harness connector according to the present invention.
Figure 12:
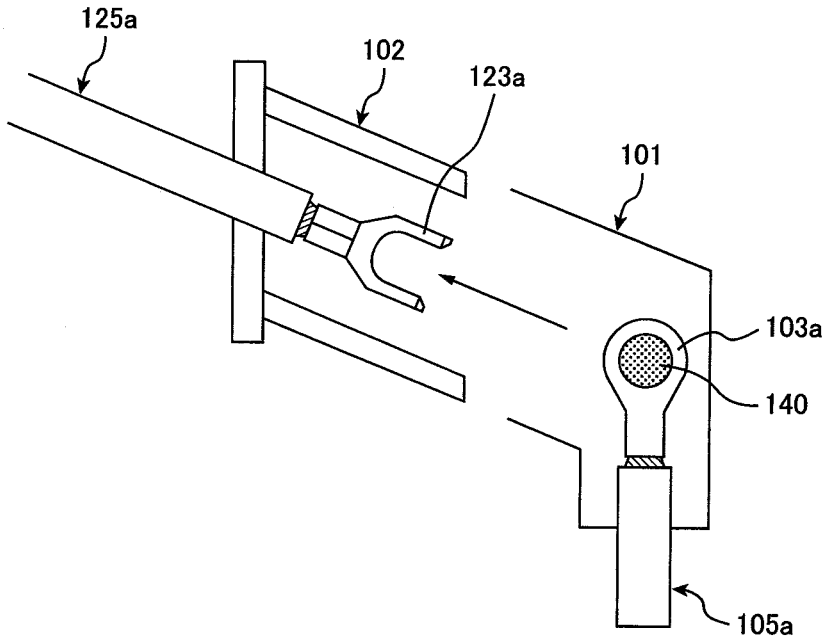

In addition, the above description is made with reference to an I-type harness connector in which the male connector 101 and the female connector 102 are adapted to be straightly connected. However, the present invention is not limited to such a connector type. FIGS. 12A and 12B are each a schematic illustration showing a top longitudinal sectional view of still another example of a harness connector according to the present invention. FIG. 12A illustrates an L-type harness connector in which the female connector 101 and the male connector 102 are adapted to be perpendicularly connected. FIG. 12B illustrates a harness connector in which the female connector 101 and the male connector 102 are adapted to be obliquely connected. Thus, any type connector can be achieved in which the female connector 101 and the male connector 102 are configured to be connected at a desired angle to each other. That is, the harness connector 100 can be configured in such a manner that when the male connector 102 is inserted into the female connector 101, the axis direction of the parallel arranged connecting portions between the first connector terminals 103*a*, 103*b* and 103*c* and the cables 105*a*, 105*b* and 105*c* is not parallel to (nor coaxial with) but obliquely oriented to the axis direction of the parallel arranged connecting portions between the second connector terminals 123*a*, 123*b* and 123*c* and the cables 125*a*, 125*b* and 125*c*.

As illustrated in FIGS. 12A and 12B, the harness connector 100 can be designed so that cables (connected to the harness connector 100) can be routed from the harness connector 100 in a desired direction depending upon the situation in which the harness connector 100 is mounted. Thus, space can be saved. It is noted that FIGS. 12A and 12B show the case where the first terminal housing (having the pressing member 138) is the female housing, and the second terminal housing (not having the pressing member 138) is the male housing.

Figure 13:
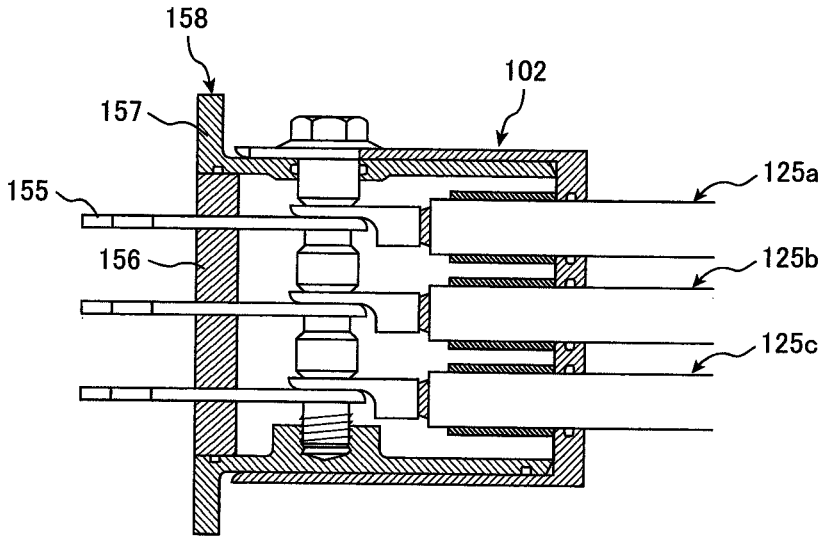
FIG. 13 is a schematic illustration showing a front longitudinal sectional view of a further example of a harness connector according to the first embodiment of the present invention.

Furthermore, the first embodiment has been described with reference to an in-line application in which two harness cables are connected by the harness connector 100. However, the first embodiment is not limited to such an application. FIG. 13 is a schematic illustration showing a longitudinal sectional view of a further example of a harness connector according to the first embodiment of the present invention. As illustrated in FIG. 13, in this example, rigid bus bars 155 are used as the first connector terminals of a male connector 158. The bus bars 155 are supported by a positioning support plate 156 made of a resin so as to be aligned in respective predetermined positions. The male connector 158 is formed by inserting the positioning support plate 156 (that supports the bus bars 155) into one end of a hollow cylinder first terminal housing 157. The bus bars 155 are, before use, preconnected to the terminals of an electrical device or the like. The female connector 102, in which the cables 125*a*, 125*b* and 125*c* are mounted, is connected to this male connector 158 in use. In this harness connector, the bus bars 155 (the first connector terminals) are rigid and are aligned by the positioning support plate 156. Therefore, there is no need for supporting each bus bar 155 by the first support member (plate) 122 shown in FIG. 2. However, when the bus bars 155 are not rigid, it is preferable to support each bus bar 155 by the first support member 122. The positioning support plate 156 (that aligningly positions the bus bars 155) can be formed, for example, by integrally forming, by insert molding, the positioning support plate 156 having preinserted therein the bus bars 155; or by press fitting the bus bars 155 into the preformed positioning support plate 156.

[Second Embodiment of Present Invention]

Figure 14:
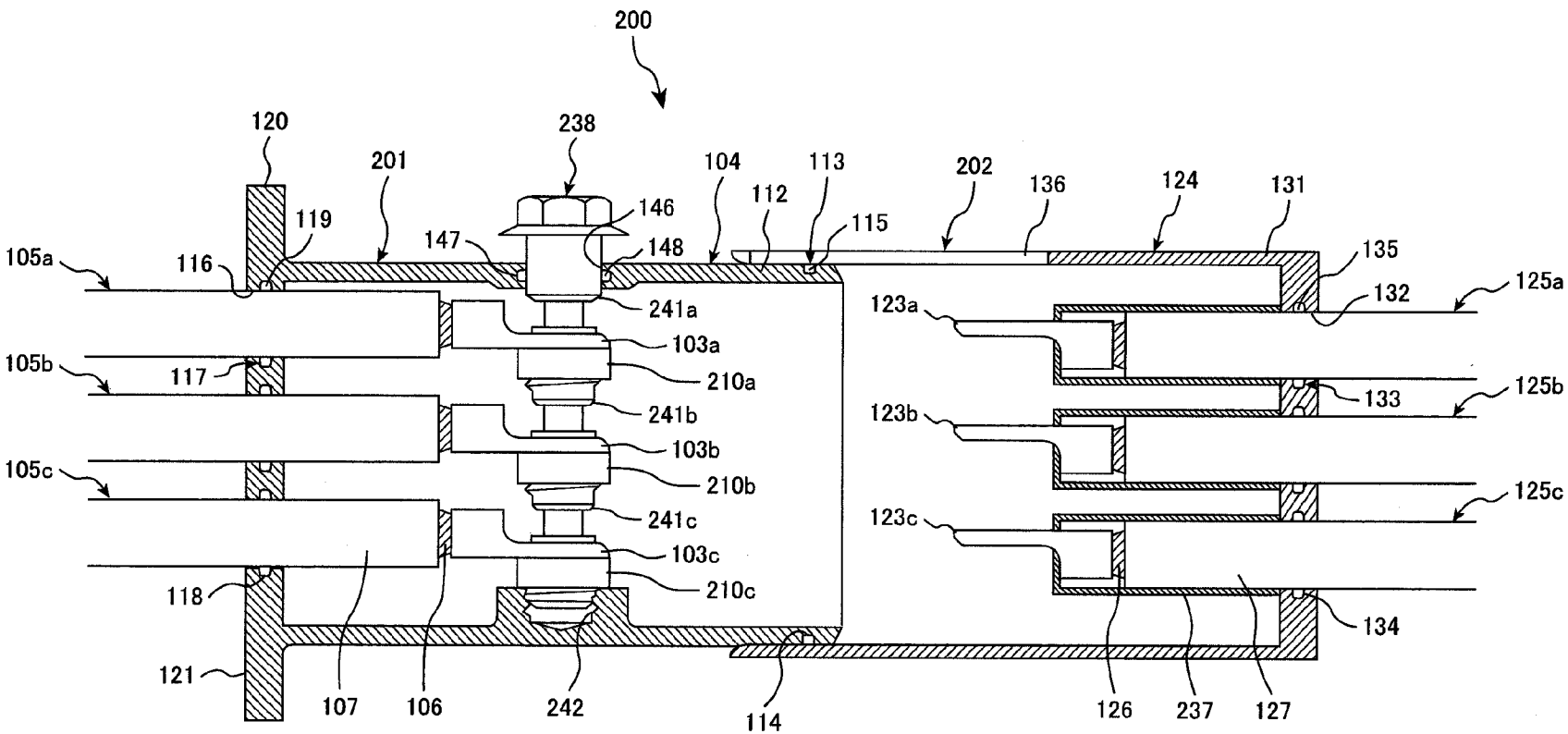
FIG. 14 is a schematic illustration showing a front longitudinal sectional view of an example of a harness connector according to a second embodiment of the present invention.

Next, a harness connector according to a second embodiment of the present invention will be described. FIG. 14 is a schematic illustration showing a front longitudinal sectional view of an example of a harness connector according to a second embodiment of the present invention.

As illustrated in FIG. 14, a harness connector 200 according to the second embodiment includes a male connector 201 and a female connector 202. By inserting the male connector 201 into the female connector 202, a plurality of power supply lines in the male connector 201 can be collectively connected to the corresponding counterpart power supply lines in the female connector 202. The harness connector 200 according to the second embodiment is different from the harness connector 100 according to the first embodiment mainly in that a pressing member 238 (detailed later in FIG. 16) is different from the pressing member 138; support members 210*a*, 210*b* and 210*c* (detailed later in FIG. 15) for supporting the first connector terminals 103*a*, 103*b* and 103*c* are different from the first support plates 122; and second support tubes 237 for supporting the second connector terminals 123*a*, 123*b* and 123*c* are different from the second support tubes 137. Other like parts are designated by the same reference numerals as used in the first embodiment without repeating the description thereof.

A plurality of second support tubes 237 are extended from the inner surface of the closed end wall of the cylinder 131 of the second terminal housing 124 of the female connector 202. Herein, the extended end of each second support tube 237 is closed. The second support tubes 237 are different from the second support tubes 137 of FIG. 4 described in the first embodiment in that the second support tubes 237 support both the second connector terminals 123*a*, 123*b* and 123*c* and the cables 125*a*, 125*b* and 125*c*, respectively.

The second support tubes 237 are made of an electrically insulation material such as resin in order to electrically insulate the second connector terminals 123*a*, 123*b* and 123*c* from one another and prevent short circuiting therebetween. The second support tubes 237 allow the second connector terminals 123*a*, 123*b* and 123*c* to be stably held in predetermined positions, even when the cables 125*a*, 125*b* and 125*c* connected with the second connector terminals 123*a*, 123*b* and 123*c* are highly flexible. Herein, the second support tubes 237 need to be designed so that the second connector terminals 123*a*, 123*b* and 123*c* can be displaced to some extent rather than being immovably fixed. When the cables 125*a*, 125*b* and 125*c* are rigid, the second support tubes 237 need not necessarily be provided in the cylinder 131. Or, the second support tubes 137 described in the first embodiment (see FIG. 4) may be used to support the second connector terminals 123*a*, 123*b* and 123*c*.

Figure 15:
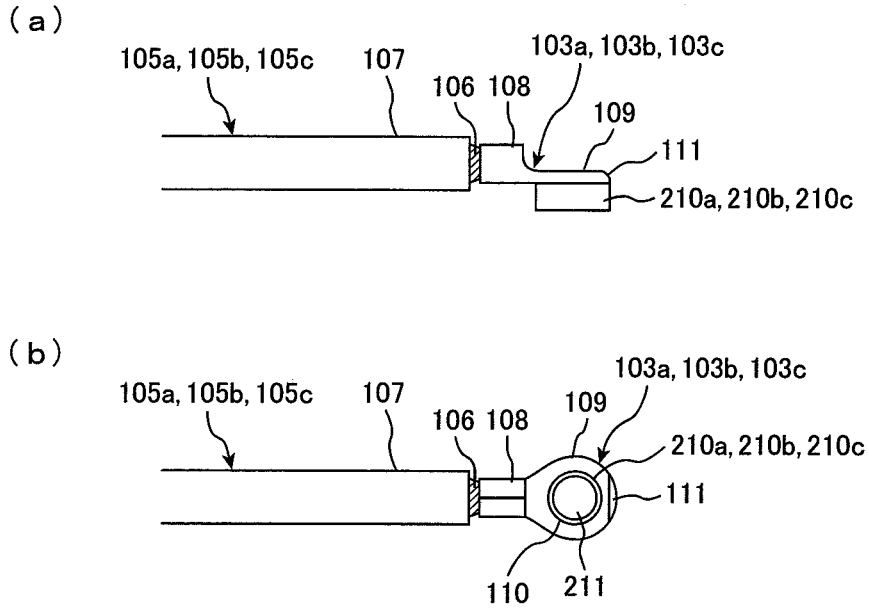
FIG. 15 is a schematic illustration showing a first connector terminal connected to a cable according to the second embodiment, in which (a) is a front view, and (b) is a top view.

FIG. 15 is a schematic illustration showing a first connector terminal connected to a cable according to the second embodiment, in which (a) is a front view, and (b) is a top view. As illustrated in FIG. 15, in the second embodiment, the ring terminals 109 of the first connector terminals 103*a*, 103*b* and 103*c* are respectively supported from the back (from the lower side of the figure, i.e., from the side opposite the side of the contact interface) by the support members 210*a*, 210*b* and 210*c* integrally formed with the respective ring terminals 109. The hole 110 of each ring terminal 109 is for the purpose of insertion of the pressing member 238. Likewise, the support members 210*a*, 210*b* and 210*c* are each provided with a hole 211 for insertion of the pressing member 238. An inner surface of the hole 211 of each of the support members 210*a*, 210*b* and 210*c* is provided with a female screw thread (i.e., each of the support members 210*a*, 210*b* and 210*c* is an internally threaded nut). And, a part of each of the nut-like support members 210*a*, 210*b* and 210*c* is press-fitted into the hole 110 of the corresponding ring terminal 109.

Figure 16:
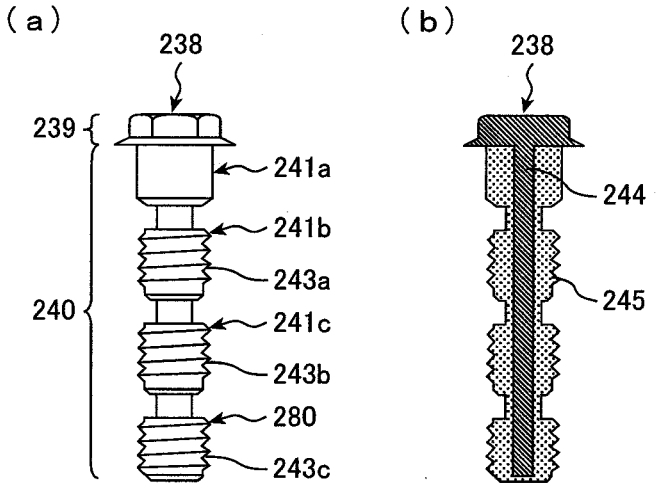
FIG. 16 is a schematic illustration showing a pressing member according to the second embodiment, in which (a) is a front view, and (b) is a front longitudinal sectional view.

FIG. 16 is a schematic illustration showing a pressing member according to the second embodiment, in which (a) is a front view, and (b) is a front longitudinal sectional view. As illustrated in FIG. 16(*a*), the pressing member 238 is a bolt 240 with a head 239, such as a hexagon headed bolt with a flange. The bolt 240 includes: three large diameter pressing portions 241*a*, 241*b* and 241*c* for pressing the second connector terminals 123*a*, 123*b* and 123*c* against the first connector terminals 103*a*, 103*b* and 103*c*, respectively; and, at un-headed end of the bolt 240, a large diameter portion 280 having the same diameter as the large diameter pressing portions 241*a*, 241*b* and 241*c*. The bottom annular edges of the large diameter pressing portions 241*a*, 241*b* and 141*c* (on the lower side in the figure) are chamfered or tapered to facilitate insertion of the second connector terminals 123*a*, 123*b* and 123*c*.

Outer surfaces of the large diameter pressing portions 241*b* and 241*c* are provided with male screw threads 243*a* and 243*b* threadedly engageable with the female screw threads of the nut-like support members 210*a*, 210*b* of the first connector terminals 103*a* and 103*b*, respectively. Also, an outer surface of the large diameter portion 280 is provided with a male screw thread 243*c* threadedly engageable with the female screw thread of the nut-like support member 210*c* of the first connector terminal 103*c*.

In addition, as illustrated in FIG. 14, the pressing member 238 is inserted in such a manner that the axis direction of the bolt 240 is perpendicular to the three contact interfaces between the first connector terminals 103*a*, 103*b* and 103*c* and the second connector terminals 123*a*, 123*b* and 123*c*; and that the first and second connector terminals 103*a* and 123*a* are positioned between the large diameter pressing portions 241*a* and 241*b*, the first and second connector terminals 103*b* and 123*b* are positioned between the large diameter pressing portions 241*b* and 241*c*, and the first and second connector terminals 103*c* and 123*c* are positioned between the large diameter pressing portion 241*c* and the large diameter portion 280. A female screw 242 as a pressing member-fixing portion, which can threadedly receive the male screw thread 243*c* of the pressing member 238, is provided in the bottom wall (on the lower side in FIG. 14) of the cylinder 112.

As illustrated in FIG. 16(*b*), the pressing member 238 preferably includes: a core rod 244 made of metal; and an insulator shell 245 made of an insulator that covers an outer surface of the core rod 244 as well as forming the large diameter pressing portions 241*a*, 241*b* and 241*c* and the large diameter portion 280. Examples of the metal used for the core rod 244 are SUS (stainless steel), iron, and copper alloys. And, examples of the insulator for the insulator shell 245 are polyphenylene sulfide (PPS) resins, polyphthalamide (PPA) resins, polyamide (PA) resins, and epoxy resins. The pressing member 238 having such composite structure of the core metal rod 244 and the insulator shell 245 has a stronger mechanical strength than any pressing member entirely formed of a resin. As described above, the insulator shell 245 (including the large diameter pressing portions 241*a*, 241*b* and 241*c* and the large diameter portion 280) are made of a resin, and therefore the pressing member 238 can be electrically insulated from the other part of the harness connector 200 and the large diameter pressing portions 241*a*, 241*b* and 241*c* and the large diameter portion 280 can be easily shaped.

Next, the connection between the first connector terminals 103*a*, 103*b* and 103*c* and the second connector terminals 123*a*, 123*b* and 123*c* in the harness connector 200 of the second embodiment will be described.

Figure 17:
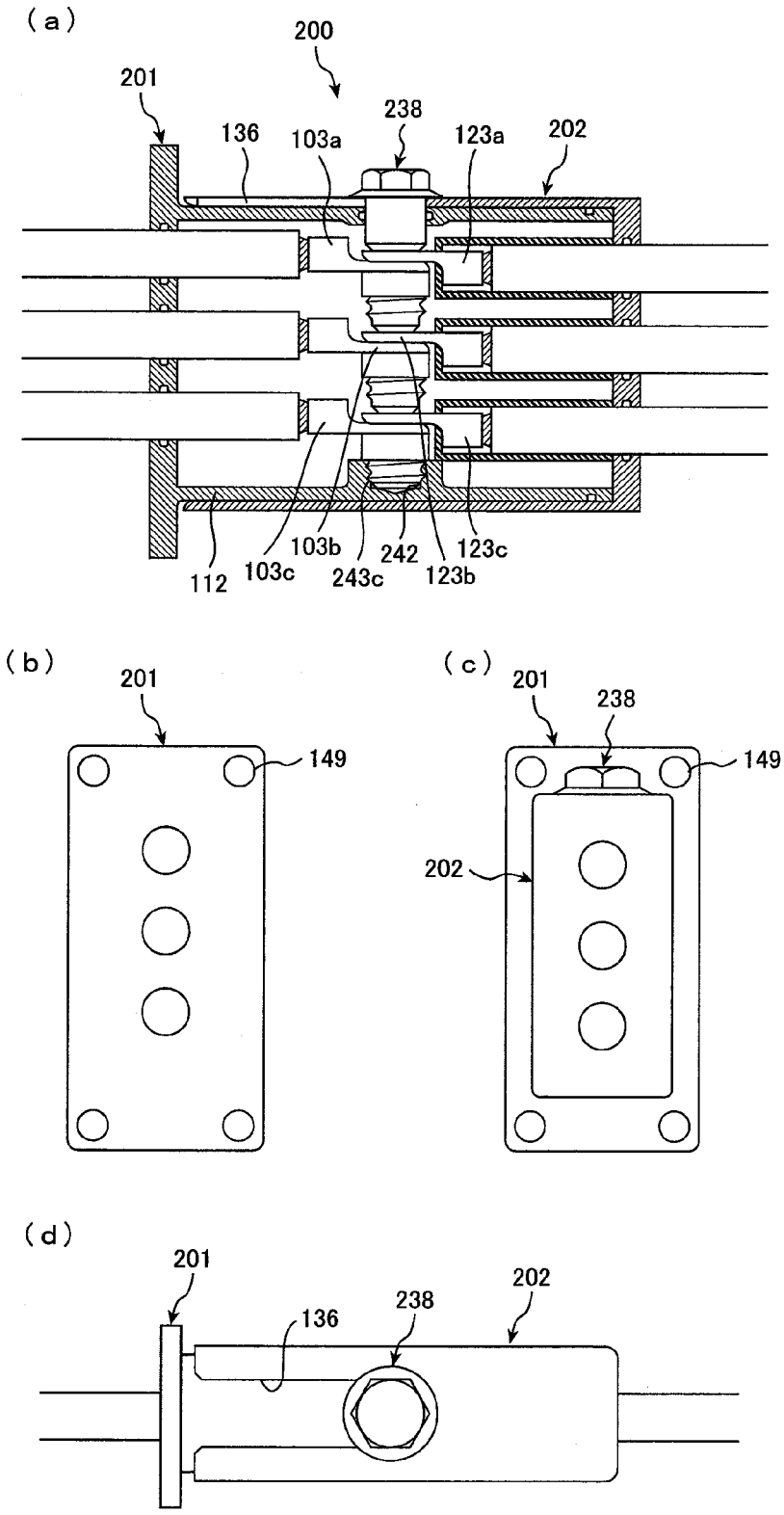
FIG. 17 is a schematic illustration showing the harness connector of FIG. 14 after the male connector is inserted in the female connector and the pressing member is screwed in, in which (a) is a front longitudinal sectional view, (b) is a side view as viewed from the male connector side, (c) is a side view as viewed from the female connector side, and (d) is a top view.

FIG. 17 is a schematic illustration showing the harness connector of FIG. 14 after the male connector is inserted in the female connector and the pressing member is screwed in, in which (a) is a front longitudinal sectional view, (b) is a side view as viewed from the male connector side, (c) is a side view as viewed from the female connector side, and (d) is a top view. As illustrated in FIG. 17, when the male connector 201 is inserted in the female connector 202 and then the pressing member 238 is screwed in, the male screw thread 243*c* of the pressing member 238 are threadedly engaged into the bottom of the female screw 242 of pressing member-fixing portion. Concurrently, the nut-like support members 210*a*, 210*b* and 210*c* are threadedly engaged with the male screw threads 243*a*, 243*b* and 243*c* of the pressing member 238, and move up along the pressing member 238. As a result, the first connector terminals 103*a*, 103*b* and 103*c* are pushed from below by the nut-like support members 210*a*, 210*b* and 210*c*, respectively.

By the downward movements of the large diameter pressing portions 241*a*, 241*b* and 241*c* and the upward movements of the first connector terminals 103*a*, 103*b* and 103*c*, the second connector terminals 123*a*, 123*b* and 123*c* are pressed between the large diameter pressing portion 241*a* and the first connector terminal 103*a*, between the large diameter pressing portion 241*b* and the first connector terminal 103*b*, and between the large diameter pressing portion 241*c* and the first connector terminal 103*c*, respectively. Thus, the second connector terminals 123*a*, 123*b* and 123*c* are forced into strong contact with the first connector terminals 103*a*, 103*b* and 103*c*, respectively.

In addition, when the male connector 201 is inserted into the female connector 202, the large diameter pressing portion 241*a* of the pressing member 238 is allowed to be inserted into the longitudinal cut-out 136 formed in an upper wall of the female connector 202. Furthermore, the female connector 202 is pressed by the head 239 of the pressing member 238 against the male connector 201; thus, the male connector 201 and the female connector 202 are tightened against each other.

As described above, in the second embodiment, the terminal pairs of the first and second connector terminals 103*a* and 123*a*, 103*b* and 123*b*, and 103*c* and 123*c* are pressed from above by means of the large diameter pressing portion 241*a*, 241*b* and 241*c* and are supported from below by means of the nut-like support member 210*a*, 210*b* and 210*c* which receives the pressing force of the pressing portion 241*a*, 241*b* and 241*c*, respectively. As a result, strong mechanical contact and therefore stable electrical contact are provided at all of the contact interfaces between the second connector terminals 123*a*, 123*b* and 123*c* and the corresponding first connector terminals 103*a*, 103*b* and 103*c*. Hence, a harness connector can be achieved which is particularly beneficially used in vibrating environments such as vehicles.

[Third Embodiment of Present Invention]

Figure 18:
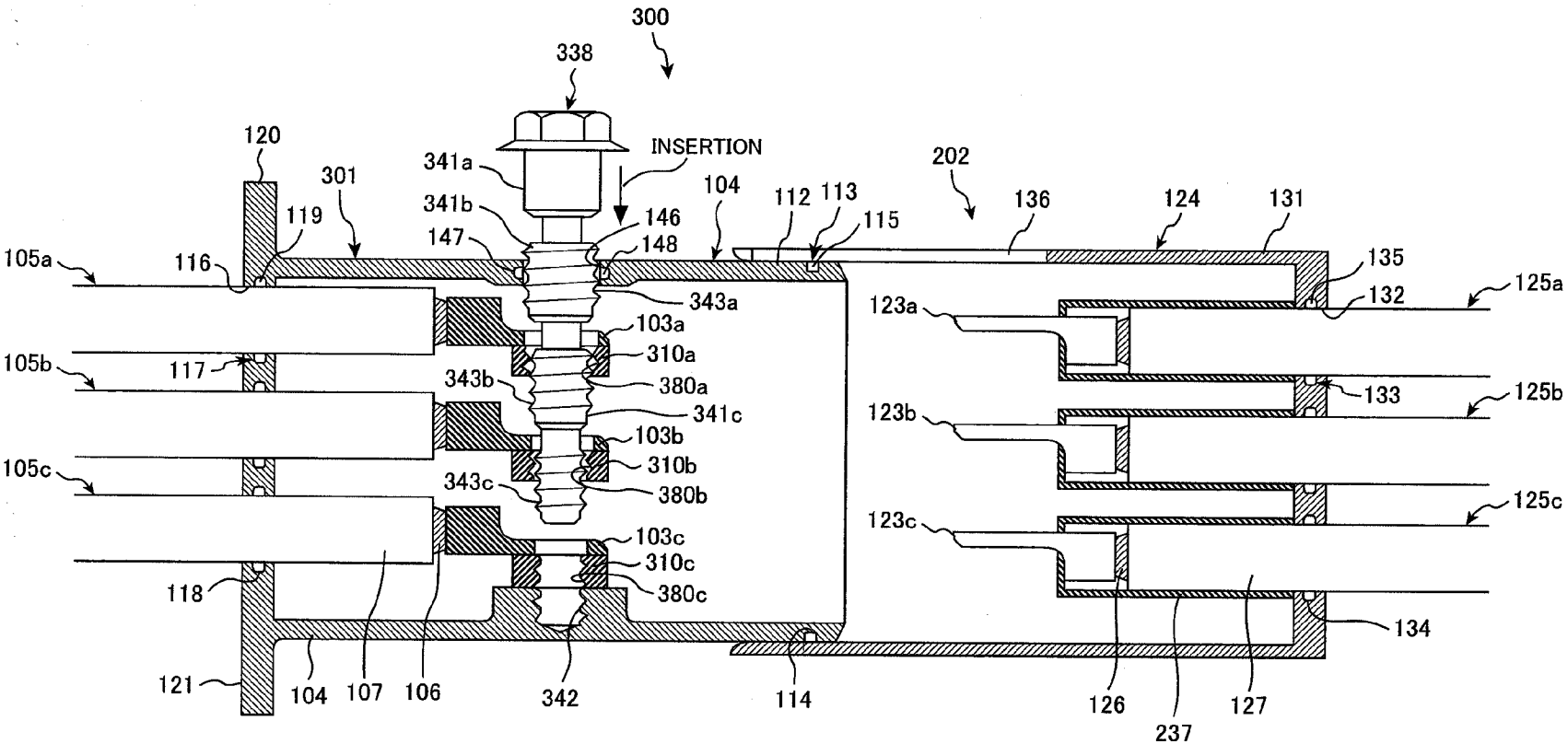
FIG. 18 is a schematic illustration showing a front longitudinal sectional view of an example of a harness connector according to a third embodiment of the present invention.

Next, a harness connector according to a third embodiment of the present invention will be described. FIG. 18 is a schematic illustration showing a front longitudinal sectional view of an example of a harness connector according to a third embodiment of the present invention.

As illustrated in FIG. 18, a harness connector 300 according to the third embodiment includes a male connector 301 and a female connector 202. By inserting the male connector 301 into the female connector 202, a plurality of power supply lines in the male connector 301 can be collectively connected to the respective counterpart power supply lines in the female connector 202. The harness connector 300 according to the third embodiment is different from the harness connector 200 according to the second embodiment mainly in that a pressing member 338 (detailed later in FIG. 19) is different from the pressing member 238; and nut-like support members 310*a*, 310*b* and 310*c* for supporting the first connector terminals 103*a*, 103*b* and 103*c* are different from the nut-like support members 210*a*, 210*b* and 210*c*. Other like parts are designated by the same reference numerals as used in the first and second embodiments without repeating the description thereof.

Figure 19:
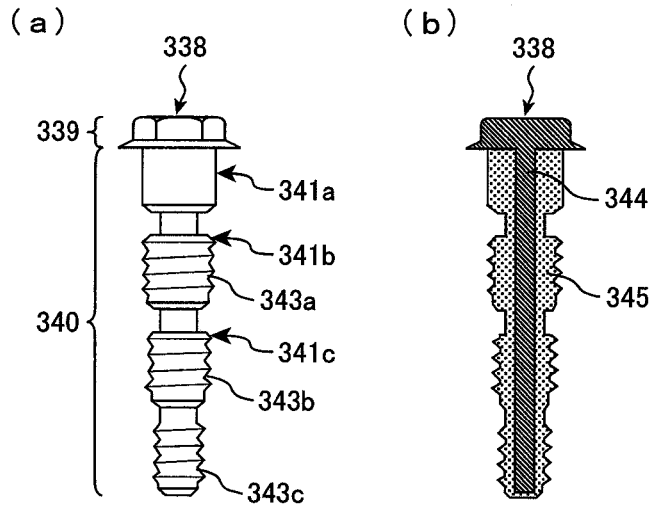
FIG. 19 is a schematic illustration showing a pressing member according to the third embodiment, in which (a) is a front view, and (b) is a front longitudinal sectional view.

FIG. 19 is a schematic illustration showing a pressing member according to the third embodiment, in which (a) is a front view, and (b) is a front longitudinal sectional view. As illustrated in FIG. 19(*a*), the pressing member 338 is a bolt 340 with a head 339, such as a hexagon headed bolt with a flange. The bolt 340 includes three large diameter pressing portions 341*a*, 341*b* and 341*c* for pressing the second connector terminals 123*a*, 123*b* and 123*c* against the first connector terminals 103*a*, 103*b* and 103*c*, respectively. Herein, the diameters of the large diameter pressing portions 341*a*, 341*b* and 341*c* decrease stepwise in this order. That is, the large diameter pressing portion 341*a* has a larger diameter than the large diameter pressing portion 341*b*, and the large diameter pressing portion 341*b* has a larger diameter than the large diameter pressing portion 341*c*. The bottom annular edges of the large diameter pressing portions 341*a*, 341*b* and 341*c* (on the lower side in the figure) are chamfered or tapered to facilitate insertion of the second connector terminals 123*a*, 123*b* and 123*c*.

Outer surfaces of the large diameter pressing portions 341*b* and 341*c* are provided with male screw threads 343*a* and

343*b* threadedly engageable with the female screw threads formed on inner surfaces of the later-described nut-like support members 310*a*, 310*b* for supporting the first connector terminals 103*a* and 103*b*, respectively. Also, an outer surface of the un-headed end of the bolt 340 is provided with a male screw thread 343*c* threadedly engageable with a female screw thread 380*c* formed on an inner surface of the later-described nut-like support member 310*c* for supporting the first connector terminal 103*c*.

As illustrated in FIG. 18, the pressing member 338 is disposed in such a manner that the axis direction of the bolt 340 is perpendicular to the three contact interfaces between the first connector terminals 103*a*, 103*b* and 103*c* and the second connector terminals 123*a*, 123*b* and 123*c*; and that the first and second connector terminals 103*a* and 123*a* are positioned between the large diameter pressing portions 341*a* and 341*b*, the first and second connector terminals 103*b* and 123*b* are positioned between the large diameter pressing portions 341*b* and 341*c*, and the first and second connector terminals 103*c* and 123*c* are positioned between the large diameter pressing portion 341*c* and the un-headed end of the bolt 340. In addition, a female screw 342 as a pressing member-fixing portion, which can threadedly receive the male screw thread 343*c* of the pressing member 338, is provided in the bottom wall (on the lower side in FIG. 20) of the cylinder 112.

As illustrated in FIG. 19(*b*), the pressing member 338 preferably includes: a core rod 344 made of metal; and an insulator shell 345 made of an insulator that covers an outer surface of the core rod 344 as well as forming the large diameter pressing portions 341*a*, 341*b* and 341*c*. Examples of the metal used for the core rod 344 are SUS (stainless steel), iron, and copper alloys. And, examples of the insulator for the insulator shell 345 are polyphenylene sulfide (PPS) resins, polyphthalamide (PPA) resins, polyamide (PA) resins, and epoxy resins. The pressing member 338 having such composite structure of the core metal rod 344 and the insulator shell 345 has a stronger mechanical strength than any pressing member entirely formed of a resin. As described above, the insulator shell 345 (including the large diameter pressing portions 341*a*, 341*b* and 341*c*) are made of a resin, and therefore the pressing member 338 can be electrically insulated from the other part of the harness connector 300 and the large diameter pressing portions 341*a*, 341*b* and 341*c* can be easily shaped.

As described above, the diameters of the large diameter pressing portions 341*a*, 341*b* and 341*c* decrease stepwise in this order, and also the diameters of the male screws 343*a*, 343*b* and 343*c* decrease stepwise in this order. And, the female screw threads 380*a*, 380*b* and 380*c* of the nut-like support members 310*a*, 310*b* and 310*c* are formed to be threadedly engageable with the male screw threads 343*a*, 343*b* and 343*c*, respectively. That is, the inner diameters of the nut-like support members 310*a*, 310*b* and 310*c* also decrease stepwise in this order. The other structures of the nut-like support members 310*a*, 310*b* and 310*c* are similar to those of the nut-like support members 210*a*, 210*b* and 210*c* of the second embodiment.

Next, the reason for employing the above described structure for the nut-like support members 310*a*, 310*b* and 310*c* will be described.

In the second embodiment, all of the male screws of the pressing member have the same diameter (thereby, all of the female screws of the nut-like support members have the same diameter). Therefore, when the pressing member is inserted or removed, the male screw at the un-headed end of the pressing member needs to be screwed into or out of all of the female screws, thus having a disadvantage of being somewhat time consuming. However, all the nut-like support members have the same size, thus having an advantage of low component cost.

In contrast, according to the third embodiment, the male screws 343*a*, 343*b* and 343*c* of the pressing member 338 (therefore, the female screws 380*a*, 380*b* and 380*c* of the nut-like support members 310*a*, 310*b* and 310*c*) have a different diameter. As a result, the male screw 343*c* at the un-headed end of the pressing member 338 can be passed through within the female screws 380*a* and 380*b* without having to be threadedly engaged therewith (likewise, the male screw 343*b* can be passed through within the female screw 380*a*). Therefore, the insertion or removal of the pressing member 338 is facilitated, thus providing better operability. However, the nut-like support members have a different size, thus having a disadvantage compared to the second embodiment in terms of component cost.

Hence, the harness connector of the third embodiment can be advantageously used for applications in which the pressing member needs to be frequently inserted or removed, while the harness connector of the second embodiment can be advantageously used for applications in which the pressing member does not need to be inserted or removed so often.

Next, the connection between the first connector terminals 103*a*, 103*b* and 103*c* and the second connector terminals 123*a*, 123*b* and 123*c* in the harness connector 300 of the third embodiment will be described.

Figure 20:
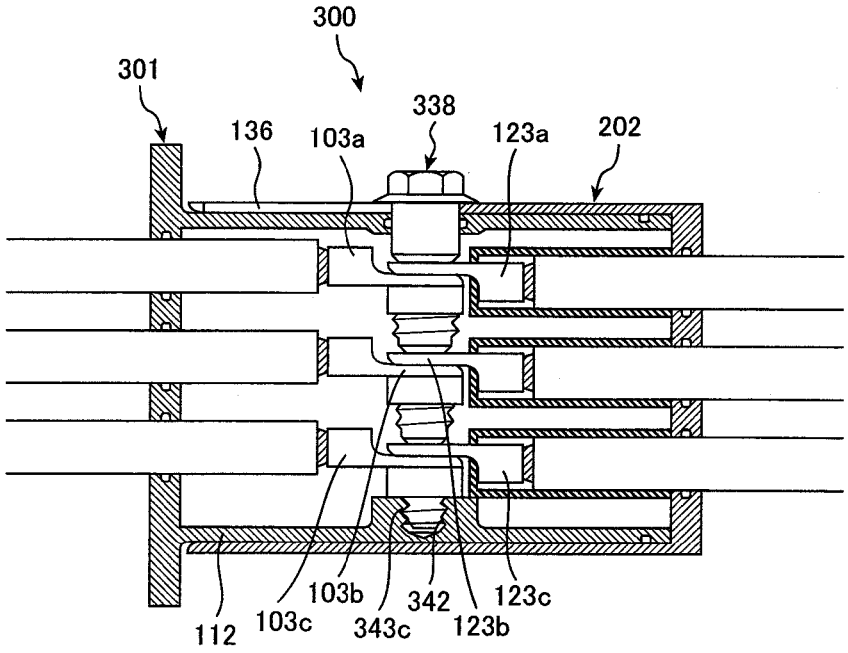

FIG. 20 is a schematic illustration showing a front longitudinal view of the harness connector of FIG. 18 after the male connector is inserted into the female connector and the pressing member is screwed in. As illustrated in FIG. 20, when the male connector 301 is inserted into the female connector 202, the large diameter pressing portion 341*a* of the pressing member 338 is allowed to be inserted into a longitudinal cut-out 136 formed in the upper wall of the female connector 202, and the second connector terminals 123*a*, 123*b* and 123*c* are inserted between the large diameter pressing portion 341*a* and the first connector terminal 103*a*, between the large diameter pressing portion 341*b* and the first connector terminal 103*b*, and between the large diameter pressing portion 341*c* and the first connector terminal 103*c*, respectively.

In addition, when the pressing member 338 is screwed in, the male screw 343*c* of the pressing member 338 is threadedly engaged into the bottom of the female screw 342 of pressing member-fixing portion. Simultaneously, the nut-like support members 310*a*, 310*b* and 310*c* are threadedly engaged with the male screw threads 343*a*, 343*b* and 343*c* of the pressing member 338, and move up along the pressing member 338. As a result, the first connector terminals 103*a*, 103*b* and 103*c* are pushed from below by the nut-like support members 310*a*, 310*b* and 310*c*, respectively.

By the downward movements of the large diameter pressing portions 341*a*, 341*b* and 341*c* and the upward movements of the first connector terminals 103*a*, 103*b* and 103*c*, the second connector terminals 123*a*, 123*b* and 123*c* are pressed between the large diameter pressing portion 341*a* and the first connector terminal 103*a*, between the large diameter pressing portion 341*b* and the first connector terminal 103*b*, and between the large diameter pressing portion 341*c* and the first connector terminal 103*c*, respectively. Thus, the second connector terminals 123*a*, 123*b* and 123*c* are forced into strong contact with the first connector terminals 103*a*, 103*b* and 103*c*, respectively. Furthermore, the female connector 202 is pressed by the head 339 of the pressing member 338 against the male connector 301; thus, the male connector 301 and the female connector 202 are tightened against each other.

As described above, in the third embodiment, the terminal pairs of the first and second connector terminals 103*a* and 123*a*, 103*b* and 123*b*, and 103*c* and 123*c* are pressed from above by means of the large diameter pressing portion 341*a*, 341*b* and 341*c* and are supported from below by means of the nut-like support member 310*a*, 310*b* and 310*c* which receives the pressing force of the pressing portion 341*a*, 341*b* and 341*c*, respectively. As a result, strong mechanical contact and therefore stable electrical contact are provided at all of the contact interfaces between the second connector terminals 123*a*, 123*b* and 123*c* and the corresponding first connector terminals 103*a*, 103*b* and 103*c*. Hence, a harness connector can be achieved which is particularly beneficially used in vibrating environments such as vehicles.

[Fourth Embodiment of Present Invention]

Next, a harness connector according to a fourth embodiment of the present invention will be described. As already described, by using a harness connector according to any one of the first to third embodiments, several different power supplies for different purposes can be collectively connected to an electrical device, a harness cable, or the like (see, e.g., FIG. 9). Herein, in some cases, the optimum contact force (screwing torque) to connect a pair of supply line connector terminals may be different depending on the type of the supply line. The fourth embodiment can be advantageously used for such cases.

The fourth embodiment employs ratchet-equipped nut-like support members to support the first connector terminals 103*a*, 103*b* and 103*c* instead of the nut-like support members 241*a*, 241*b* and 241*c* of the second embodiment or the nut-like support members 341*a*, 341*b* and 341*c* of the third embodiment. Specifically, each ratchet-equipped nut-like support member of the fourth embodiment works to disengage the corresponding first connector terminal from the pressing member when receiving a screwing torque greater than a preset value; thus each pair of connector terminals can be pressed by a predetermined desirable force.

Figure 21:
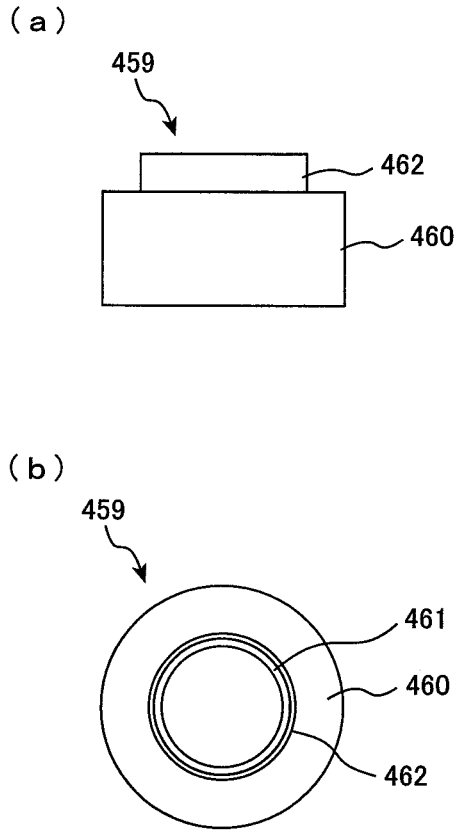
FIG. 21 is a schematic illustration showing a ratchet-equipped nut-like support member according to a fourth embodiment of the present invention, in which (a) is a front view, and (b) is a top view.

FIG. 21 is a schematic illustration showing a ratchet-equipped nut-like support member according to a fourth embodiment of the present invention, in which (a) is a front view, and (b) is a top view. As illustrated in FIG. 21, each ratchet-equipped nut-like support member 459 includes: a nut housing 460; a nut 461; and a spring assembly 464 (described later in FIG. 22) disposed between the nut housing 460 and the nut 461. Each nut housing 460 comprises: a housing portion for accommodating the nut 461; and a press-fitted portion 462 that is press-fitted in the hole 110 of the corresponding one of the first connector terminals 103*a*, 103*b* and 103*c*.

Figure 22:
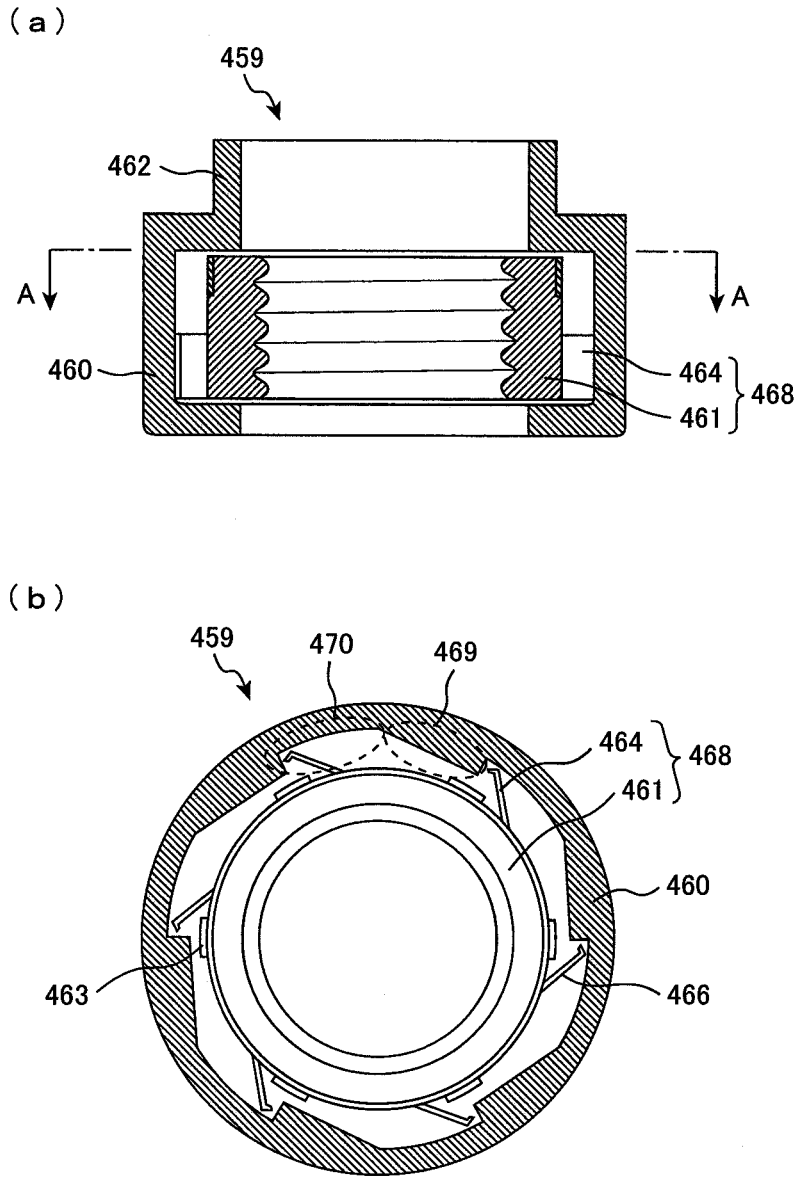
FIG. 22 is a schematic illustration showing sectional views of the ratchet-equipped nut-like support member of FIG. 21, in which (a) is a front longitudinal sectional view, and (b) is a cross sectional view taken along A-A line in (a).

FIG. 22 is a schematic illustration showing sectional views of the ratchet-equipped nut-like support member of FIG. 21, in which (a) is a front longitudinal sectional view, and (b) is a cross sectional view taken along A-A line in (a). As illustrated in FIG. 22, the nut 461 has, on an outer surface thereof, a plurality of protrusions 463 which are circumferentially spaced apart by a predetermined distance. Each protrusion 463 is designed to have such a height as not to plastically deform (collapse) corresponding leaf spring 466 of the spring assembly 464. The spring assembly 464 is fitted around the nut 461 to form a rack 468. An inner surface of each nut 461 is provided with a female screw thread threadedly engageable with the corresponding one of the male screw threads 243*a*, 242*b* and 243*c* of the pressing member 238 (or the male screw threads 343*a*, 343*b* and 343*c* of the pressing member 338).

Furthermore, an inner surface of the nut housing 460 is provided with circumferentially alternately arranged protrusions (small inner diameter portions 469) and depressions (edge or large inner diameter portions 470) in order to limit the rotation of the rack 468 to one direction.

Figure 23:
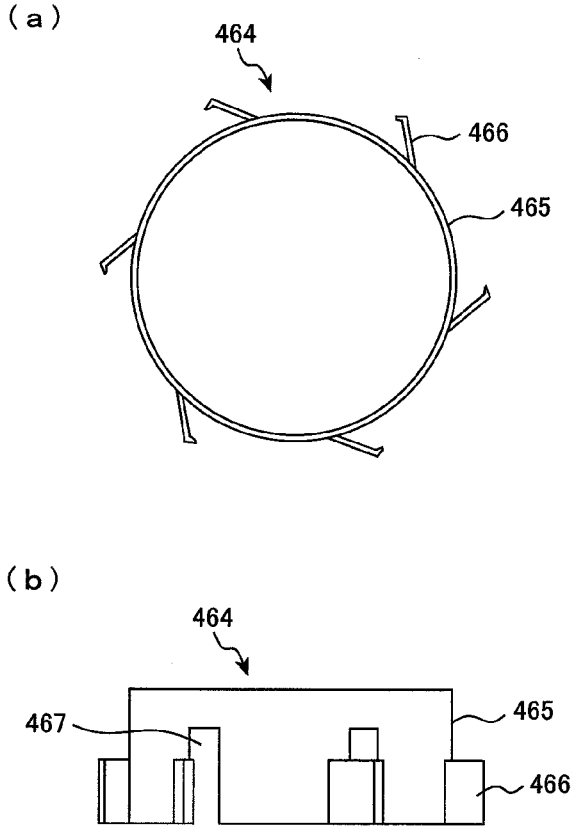
FIG. 23 is a schematic illustration showing the spring assembly of FIG. 22, in which (a) is a top view, and (b) is a front view.

FIG. 23 is a schematic illustration showing the spring assembly of FIG. 22, in which (a) is a top view, and (b) is a front view. As illustrated in FIG. 23, the spring assembly 464 includes a cylinder 465 and, on an outer surface of the cylinder 465, a plurality of circumferentially equally spaced leaf springs 466 that obliquely extend outwardly from the outer surface of the cylinder 465.

The wall of the cylinder 465 has a plurality of cut-outs 467 that can receive the protrusion 463 of the nut 461. The extended end of each leaf spring 466 is bent inwardly toward the cylinder 465.

Figure 24:
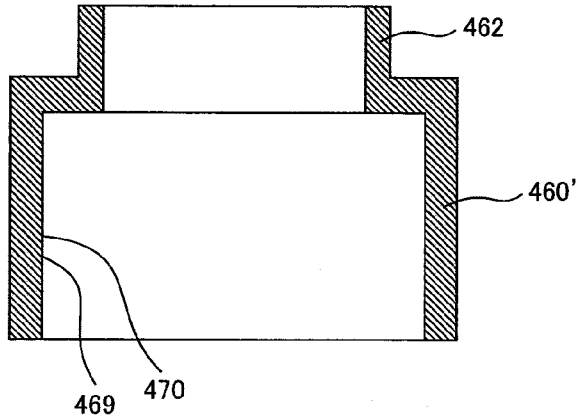
FIG. 24 is a schematic illustration showing a front longitudinal sectional view of a cylinder used to form a nut housing.
Figure 25:
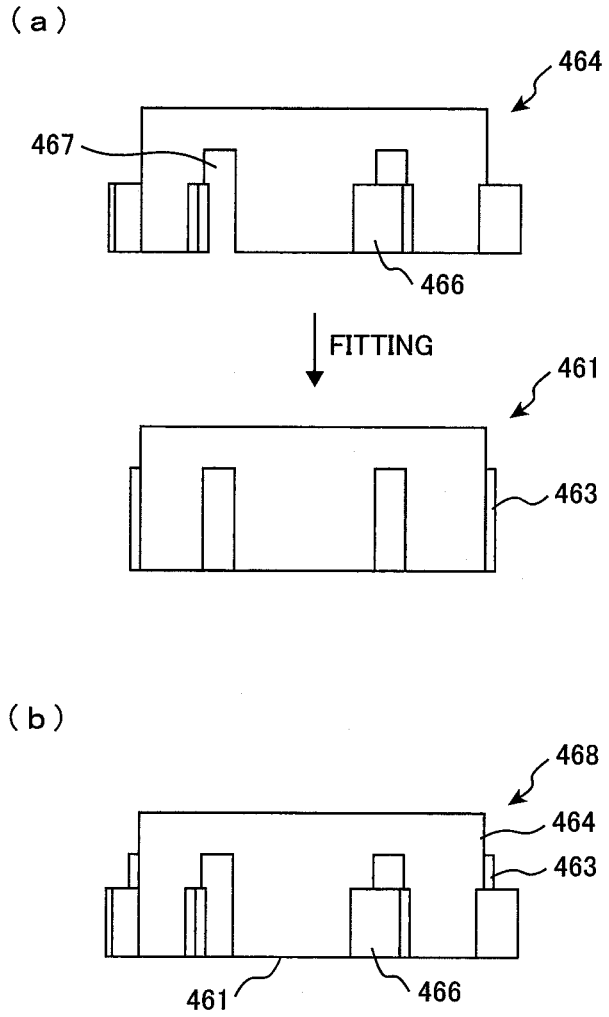
FIG. 25 is a schematic illustration showing front views of a rack, in which (a) shows a method for assembling the rack, and (b) shows the rack after assembly.
Figure 26:
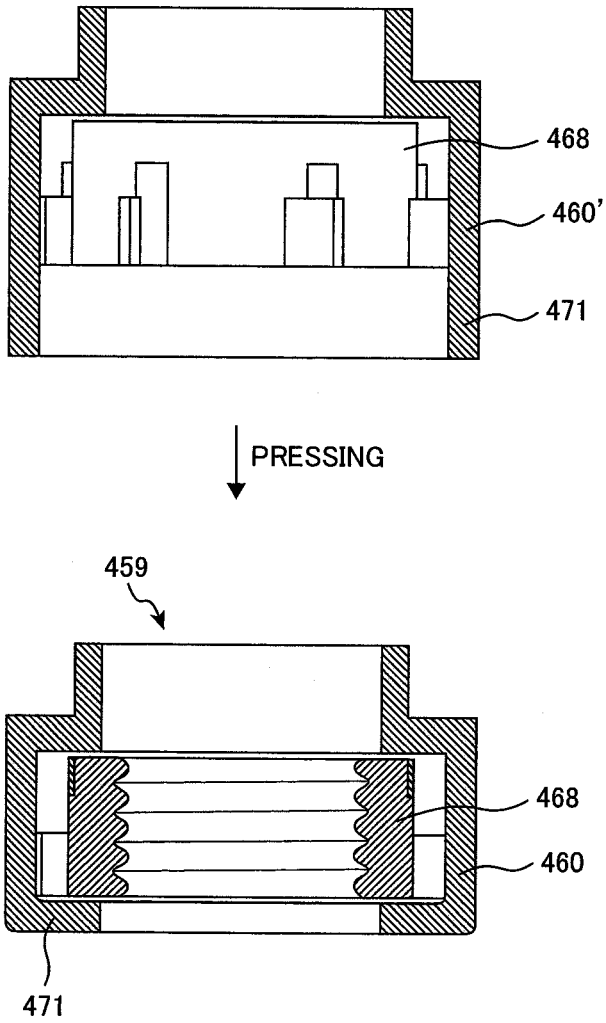
FIG. 26 is a schematic illustration showing front longitudinal sectional views of a method of fabricating a ratchet-equipped nut-like support member according to the fourth embodiment.

Next, a method of fabricating the ratchet-equipped nut-like support member 459 will be described. FIG. 24 is a schematic illustration showing a front longitudinal sectional view of a cylinder used to form a nut housing. FIG. 25 is a schematic illustration showing front views of a rack, in which (a) shows a method for assembling the rack, and (b) shows the rack after assembly. FIG. 26 is a schematic illustration showing front longitudinal sectional views of a method of fabricating a ratchet-equipped nut-like support member according to the fourth embodiment.

First, as illustrated in FIG. 24, there is prepared a nut housing component 460' in which the press-fitted portion 462 is formed at one end thereof, and the small inner diameter portions 469 and the edge (large inner diameter) portions 470 are formed on the inner surface thereof. Then, as illustrated in FIG. 25, the protrusions 463 of the nut 461 are inserted into cutout portions 467 of the spring assembly 464. Thus, the spring assembly 464 is fitted around the nut 461 so that the rack 468 is obtained. Finally, as illustrated in FIG. 26, the rack 468 is inserted into the nut housing component 460' and then a skirt portion 471 of the nut housing component 460' (the wall of the nut housing component 460' at the larger diameter end thereof) is inwardly bent by pressing or the like. Thus, the ratchet-equipped nut-like support member 459 is obtained.

Next, with reference to FIGS. 16, 17, 19 and 20, there will be described how the first connector terminals are pressed by the pressing member 238 (or 338) and the first connector terminals are supported by the ratchet-equipped nut-like support members 459. Let us now consider the case where, in FIG. 17 (or 20), the ratchet-equipped nut-like support members 459 of the fourth embodiment are used to support the first connector terminals 103*a*, 103*b* and 103*c* instead of the nut-like support members 210*a*, 210*b* and 210*c* (or 310*a*, 310*b* and 310*c*).

When the pressing member 238 (or 338) (which is a right-hand screw in FIG. 16 (19)) is screwed in, the rack 468 of the ratchet-equipped nut-like support member 459 is forced to rotate clockwise. However, when the leaf springs 466 rotate to come into contact with the small inner diameter portions 469, the contact force applied by the leaf springs 466 on the surfaces of the small inner diameter portions 469 becomes stronger and prevents the rack 468 from rotating any longer. After that, when the pressing member 238 (or 338) is further screwed in, the first connector terminals 103*a*, 103*b* and 103*c* are pushed (or at least supported) from below by means of the corresponding ratchet-equipped nut-like support members 459. As a result, the second connector terminals 123*a*, 123*b* and 123*c* are pressed and fixed between the first connector terminals 103*a*, 103*b* and 103*c* and the large diameter pressing portions 241*a*, 241*b* and 241*c* (or the large diameter pressing portions 341*a*, 341*b* and 341*c*), respectively.

However, when the pressing member 238 (or 338) is still further screwed in and the screwing torque comes to exceed a predetermined value, the contact force applied by the leaf springs 466 can no longer prevent the rack 468 from rotating, and the leaf springs 466 start to elastically deform (bend) inwardly, and finally the rack 468 starts to rotate with the pressing member 238 (or 338). By the above action of the ratchet-equipped nut-like support members 459 and the pressing member 238 (or 338), each pair of the female and male connector terminals is not pressed against each other by a force greater than a corresponding predetermined value, i.e., the each pair is pressed against each other by a corresponding suitable force. The pressing force for pressing each pair of the female and male connector terminals can be adjusted by using a leaf spring 466 having a corresponding suitable spring force.

On the contrary, when the pressing member 238 (or 338) is unscrewed counterclockwise, the extended end of each leaf spring 466 is hooked into a bottom corner (on the left side in FIG. 22(*b*)) of the corresponding edge (large inner diameter) portion 470. Thus, the rack 468 is fixed by the nut housing 460 and does not rotate. Therefore, the pressing member 238 (or 338) can be readily loosened.

Thus, by supporting the first connector terminals 103*a*, 103*b* and 103*c* by means of the ratchet-equipped nut-like support members 459, each pair of the female and male connector terminals can pressed against each other by a corresponding desired pressing force.

The fourth embodiment has been described with reference to a harness connector that collectively connects a plurality of sets of power supply lines for different purposes to an electrical device, a harness cable or the like. However, naturally, the fourth embodiment can also be applied to a harness connector that collectively connects one set of power supply lines for a single purpose to an electrical device, a harness cable or the like. The fourth embodiment can be advantageously applied also to this case in which all pairs of the female and male connector terminals can be more equally and stably pressed against each other.

The harness connector according to the present invention has been described with reference to various embodiments. However, the invention is not limited to these specific embodiments described above, but includes various alternatives and modifications that fall within the true spirit and scope of the invention.

Figure 27A:
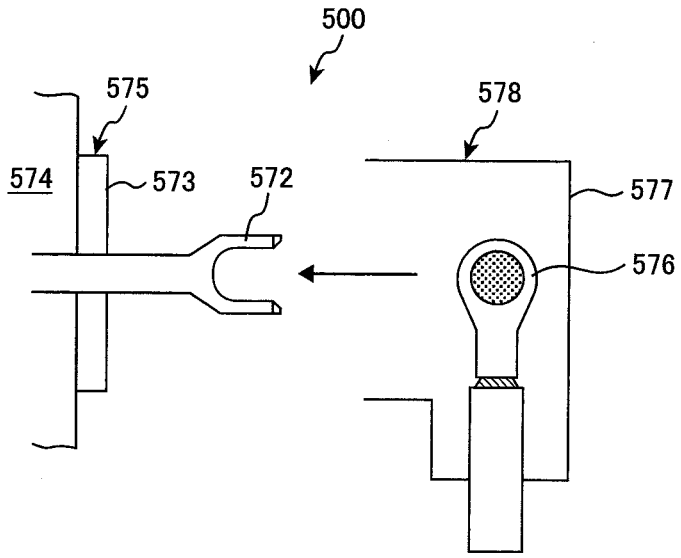
FIG. 27A is a schematic illustration showing a top longitudinal sectional view of a still further example of a harness connector of the present invention.
Figure 27B:
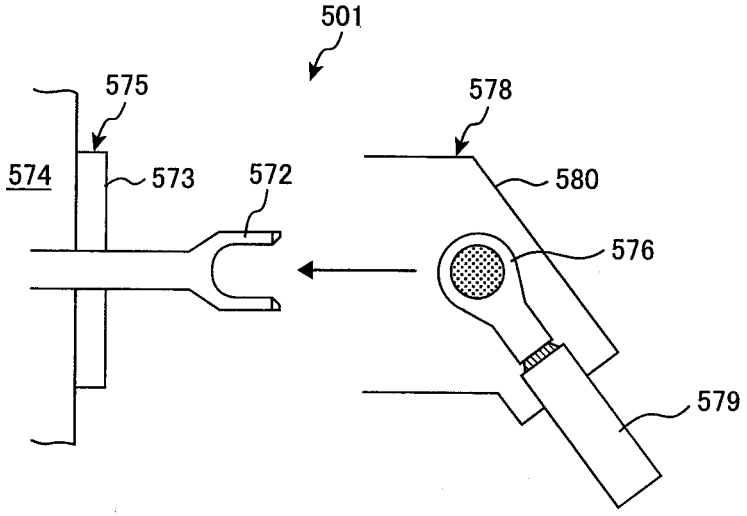
FIG. 27B is a schematic illustration showing a top longitudinal sectional view of yet a further example of a harness connector of the present invention.

FIGS. 27A and 27B are schematic illustrations showing top longitudinal sectional views of yet another application of a harness connector of the present invention. FIG. 27A illustrates a harness connector 500 according to the invention which includes a female connector 575 and a male connector 578. The female connector 575 is a second terminal housing 573 accommodating a plurality of second connector terminals 572 and is integrally formed with a casing 574 of an electronic device. And, the second connector terminals 572 are connected with corresponding terminals of a circuit of the electronic device. The male connector 578 is a first terminal housing 577 accommodating a plurality of first connector terminals 576. In use, the male connector 578 is inserted into the female connector 575 in such a manner that the first connector terminals 576 are connected with the corresponding second connector terminals 572.

FIG. 27B illustrates a harness connector 501 according to the invention in that each first connector terminal 576 can be obliquely connected with the corresponding second connector terminal 572 by using a first terminal housing 580. Thus, by modifying the first terminal housing 580, cables 579 can be routed from the connector 501 in a desired direction.

Furthermore, in the embodiments described above, the female screw of the pressing member-fixing portion is formed in the bottom wall of the first terminal housing. However, the invention is not limited to such a structure. For example, a throughhole for allowing passage of the pressing member therethrough may be formed in the bottom wall of the first terminal housing and a female screw may be formed in the bottom wall of the second terminal housing. Or, a female screw may be formed in both the first and second terminal housings. In addition, the pressing member does not necessarily need to be fixed by a female screw at the un-headed end of the bolt of the pressing member, but instead may be fixed by a female screw at a neck of the bolt of the pressing member near its head.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A harness connector comprising:

a first terminal housing with a plurality of first connector terminals aligned and accommodated therein;

a second terminal housing with a plurality of second connector terminals aligned and accommodated therein, the second terminal housing being engaged with the first terminal housing in use, each of the first connector terminals being connected with a counterpart one of the second connector terminals; and a pressing member, wherein:

when the first and second terminal housings are engaged with each other, the first and second connector terminals are alternately stacked in such a manner as to provide stack of a plurity of terminal pairs consisting of a different one of the first connector terminals and its counterpart second connector terminal; the first and second connector terminals of each terminal pair are pressed and fixed against each other by means of the pressing member and are electrically connected; and neighboring terminal pairs are electrically insulated from each other, wherein each of the first connector terminals has a first connecting portion to which a cable is connected in use, and all the first connecting portions are arranged in parallel; wherein each of the second connector terminals has a second connecting portion to which a cable is connected in use, and all the second connecting portions are arranged in parallel; and wherein the first and second terminal housings are engageable with each other in such a manner that an axis direction of the first connecting portions is not parallel but obliquely oriented to that of the second connecting portions.

2. A harness connector comprising:

a first terminal housing with a plurality of first connector terminals aligned and accommodated therein;

a second terminal housing with a plurality of second connector terminals aligned and accommodated therein, the second terminal housing being engaged with the first terminal housing in use, each of the first connector terminals being connected with a counterpart one of the second connector terminals; and a pressing member, wherein:

when the first and second terminal housings are engaged with each other, the first and second connector terminals are alternately stacked in such a manner as to provide a stack of a plurality of terminal pairs consisting of a different one of the first connector terminals and its counterpart second connector terminal; the first and second connector terminals of each terminal pair are pressed and fixed against each other by means of the pressing member and are electrically connected; and neighboring terminal pairs are electrically insulated from each other, wherein the pressing member is electrically insulated from the other part of the harness connector; the pressing member at least includes a bolt and a plurality of pressing portions each for pressing a corresponding one of the terminal pairs; and an outer surface of each pressing portion has a male screw thread, wherein each first connector terminal has, on a surface opposite a contact surface adapted to contact the corresponding counterpart second connector terminal, a nut-like support member that has a hole through which the pressing member can pass; and an inner surface of the hole of each nut-like support member has a female screw thread that can engage with the male screw thread formed on an outer surface of a corresponding one of the pressing portions, and wherein when the first and second terminal housings are engaged with each other, the pressing member is inserted in the stack of the terminal pairs in such a manner that an axis direction of the bolt of the pressing member is perpendicular to contact interfaces of the terminal pairs and each pressing portion is positioned on the corresponding terminal pair.

3. The harness connector according to claim 2, wherein the pressing member is formed of a metal core rod and an insulator shell which covers an outer surface of the metal core rod as well as forming the pressing portions of the pressing member.

4. The harness connector according to claim 2, wherein the first and/or second terminal housing has a pressing member-fixing portion for fixing the pressing member, and wherein when the first and second terminal housings are engaged with each other, the first and second terminal housings are tightened against each other by means of the pressing member.

5. The harness connector according to claim 4, wherein: the pressing member has a male screw threaded end; the pressing member-fixing portion has, formed therein, a female screw thread that can engage with the male screw threaded end; and the pressing member-fixing portion is provided in an inner surface of the first terminal housing.

6. The harness connector according to claim 2, wherein each nut-like support member has therein a ratchet which disengages the nut-like support member from the pressing member when a screwing torque greater than a predetermined value is applied to the pressing member.

7. The harness connector according to claim 2, wherein each of the second connector terminals is supported by a corresponding second support member provided in the second terminal housing so as to be aligned in a corresponding predetermined position.

8. The harness connector according to claim 2, wherein the first and/or second terminal housing is provided with a waterproof seal for waterproofing between the first and second terminal housings when the first and second terminal housings are engaged with each other.

9. The harness connector according to claim 2, wherein the first terminal housing is provided with a plurality of first cable insertion holes each for insertion of a cable which is in use connected to a corresponding one of the first connector terminals; and each first cable insertion hole is provided with a waterproof seal for waterproofing between the first terminal housing and the cable that is in use inserted through the first cable insertion hole, and wherein the second terminal housing is provided with a plurality of second cable insertion holes each for insertion of a cable that is in use connected to a corresponding one of the second connector terminals; and each second cable insertion hole is provided with a waterproof seal for waterproofing between the second terminal housing and the cable that is in use inserted through the second cable insertion hole.

10. The harness connector according to claim 2, wherein each of the first connector terminals has a first connecting portion to which a cable is connected in use, and all the first connecting portions are arranged in parallel; wherein each of the second connector terminals has a second connecting portion to which a cable is connected in use, and all the second connecting portions are arranged in parallel; and wherein the first and second terminal housings are engageable with each other in such a manner that an axis direction of the first connecting portions is not parallel but obliquely oriented to that of the second connecting portions.

11. A harness connector comprising:

a first terminal housing with a plurality of first connector terminals aligned and accommodated therein;

a second terminal housing with a plurality of second connector terminals aligned and accommodated therein, the second terminal housing being engaged with the first terminal housing in use, each of the first connector terminals being connected with a counterpart one of the second connector terminals; and a pressing member, wherein:

when the first and second terminal housings are engaged with each other, the first and second connector terminals are alternately stacked in such a manner as to provide a stack of a plurality of terminal pairs consisting of a different one of the first connector terminals and its counterpart second connector terminal; the first and second connector terminals of each terminal pair are pressed and fixed against each other by means of the pressing member and are electrically connected; and neighboring terminal pairs are electrically insulated from each other, wherein the pressing member is electrically insulated from the other part of the harness connector; the pressing member at least includes a head, a bolt and a plurality of pressing portions each for pressing a corresponding one of the terminal pairs; outer diameters of the pressing portions decrease stepwise along the bolt as the pressing portions get off from the head; and an outer surface of each pressing portion has a male screw thread, wherein each first connector terminal has, on a surface opposite a contact surface adapted to contact the corresponding counterpart second connector terminal, a nut-like support member that has a hole through which the pressing member can pass; and an inner surface of the hole of each nut-like support member has a female screw thread that can engage with the male screw thread formed on the outer surface of a corresponding one of the pressing portions, and wherein when the first and second terminal housings are engaged with each other, the pressing member is inserted in the stack of the terminal pairs in such a manner that an axis direction of the bolt of the pressing member is perpendicular to contact interfaces of the terminal pairs and each pressing portion is positioned on the corresponding terminal pair.

12. The harness connector according to claim 11, wherein the pressing member is formed of a metal core rod and an insulator shell which covers an outer surface of the metal core rod as well as forming the pressing portions of the pressing member.

13. The harness connector according to claim 11, wherein the first and/or second terminal housing has a pressing member-fixing portion for fixing the pressing member, and wherein when the first and second terminal housings are engaged with each other, the first and second terminal housings are tightened against each other by means of the pressing member.

14. The harness connector according to claim 13, wherein: the pressing member has a male screw threaded end; the pressing member-fixing portion has, formed therein, a female screw thread that can engage with the male screw threaded end; and the pressing member-fixing portion is provided in an inner surface of the first terminal housing.

15. The harness connector according to claim 11, wherein each nut-like support member has therein a ratchet which disengages the nut-like support member from the pressing member when a screwing torque greater than a predetermined value is applied to the pressing member.

16. The harness connector according to claim 11, wherein each of the second connector terminals is supported by means of a corresponding second support member provided in the second terminal housing so as to be aligned in a corresponding predetermined position.

17. The harness connector according to claim 11, wherein the first and/or second terminal housing is provided with a waterproof seal for waterproofing between the first and second terminal housings when the first and second terminal housings are engaged with each other.

18. The harness connector according to claim 11, wherein the first terminal housing is provided with a plurality of first cable insertion holes each for insertion of a cable which is in use connected to a corresponding one of the first connector terminals; and each first cable insertion hole is provided with a waterproof seal for waterproofing between the first terminal housing and the cable that is in use inserted through the first cable insertion hole, and wherein the second terminal housing is provided with a plurality of second cable insertion holes each for insertion of a cable that is in use connected to a corresponding one of the second connector terminals; and each second cable insertion hole is provided with a waterproof seal for waterproofing between the second terminal housing and the cable that is in use inserted through the second cable insertion hole.

19. The harness connector according to claim 11, wherein each of the first connector terminals has a first connecting portion to which a cable is connected in use, and all the first connecting portions are arranged in parallel; wherein each of the second connector terminals has a second connecting portion to which a cable is connected in use, and all the second connecting portions are arranged in parallel; and wherein the first and second terminal housings are engageable with each other in such a manner that an axis direction of the first connecting portions is not parallel but obliquely oriented to that of the second connecting portions.

* * * * *